US011648575B2

(12) United States Patent
DeJong et al.

(10) Patent No.: US 11,648,575 B2
(45) Date of Patent: May 16, 2023

(54) DIP TUBE CONNECTORS AND PUMP SYSTEMS USING THE SAME

(71) Applicant: The Clorox Company, Oakland, CA (US)

(72) Inventors: David L. DeJong, Ogden, UT (US); Eric C. Scheier, Lee's Summit, MO (US); Joseph R. Krestine, Leawood, KS (US); Joseph K. Dodd, Lee's Summit, MO (US); Alejandro Espinoza, Overland Park, KS (US); Dennis J. Kelly, Lee's Summit, MO (US); Lluis Costa Quintas, Barcelona (ES); Robert J. Good, Lee's Summit, MO (US); Steven L. Sweeton, Lake Winnebago, MO (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 17/128,440

(22) Filed: Dec. 21, 2020

(65) Prior Publication Data

US 2021/0107022 A1 Apr. 15, 2021

Related U.S. Application Data

(60) Continuation of application No. 16/579,710, filed on Sep. 23, 2019, now Pat. No. 10,870,122, which is a (Continued)

(51) Int. Cl.

| | |
|---|---|
| ***B05B 11/00*** | (2006.01) |
| ***B05B 15/30*** | (2018.01) |
| ***B05B 11/10*** | (2023.01) |

(52) U.S. Cl.

CPC ..... *B05B 11/1011* (2023.01); *B05B 11/0044* (2018.08); *B05B 11/0089* (2013.01); (Continued)

(58) Field of Classification Search

CPC ..... B05B 11/3011; B05B 11/0044; B05B 11/0089; B05B 11/3045; B05B 15/30; B65D 1/323; B65D 1/326

(Continued)

(56) References Cited

U.S. PATENT DOCUMENTS 4,157,774 A 6/1979 Micallef
4,863,071 A * 9/1989 Guss ..... B05B 15/30 222/207

(Continued)

FOREIGN PATENT DOCUMENTS

EP 2020264 A2 2/2009
EP 2092985 A1 8/2009

(Continued)

OTHER PUBLICATIONS

International Search Report dated Oct. 1, 2012 for PCT/US2012/029468.

(Continued)

*Primary Examiner* — Benjamin R Shaw
(74) *Attorney, Agent, or Firm* — Harness, Dickey & Pierce, P.L.C.

(57) ABSTRACT

A pump system may include a blown-in dip tube connected to a valve body and having a connection which may include an improved blown-in dip tube connector having one or more of a lip for sealing with a blown-in dip tube, a seal ring configured to mate with a blown-in dip tube and seal therewith, a dip tube lock for mating with a blown-in dip tube, or an o-ring for providing an improved seal with a blown-in dip tube.

19 Claims, 31 Drawing Sheets

Related U.S. Application Data continuation of application No. 15/206,758, filed on Jul. 11, 2016, now Pat. No. 10,421,090, which is a division of application No. 14/341,951, filed on Jul. 28, 2014, now Pat. No. 9,387,500, which is a division of application No. 13/285,576, filed on Oct. 31, 2011, now Pat. No. 8,800,822, which is a continuation-in-part of application No. 13/068,875, filed on Mar. 15, 2011, now Pat. No. 9,827,581.

(52) U.S. Cl.
CPC ..... *B05B 11/1045* (2023.01); *B05B 11/1047* (2023.01); *B05B 15/30* (2018.02); *B05B 11/0037* (2013.01)

(58) Field of Classification Search
USPC ..... 222/382
See application file for complete search history.

(56) References Cited

U.S. PATENT DOCUMENTS 4,911,361 A 3/1990 Tada
RE33,480 E 12/1990 Guss et al.
5,152,431 A 10/1992 Gardner et al.
5,192,007 A 3/1993 Blomquist
5,244,126 A 9/1993 Geier
5,246,146 A 9/1993 Bartimes et al.
5,303,851 A 4/1994 Libit et al.
5,335,821 A 8/1994 Osgar
5,433,350 A 7/1995 Graubart
5,464,129 A 11/1995 Ho
5,590,815 A 1/1997 Montaner et al.
5,638,994 A * 6/1997 Libit ..... G01F 11/084 222/215
5,794,822 A * 8/1998 Foster ..... B05B 11/3045 222/383.1
5,988,456 A 11/1999 Laible
6,032,814 A 3/2000 Foster
6,102,255 A 8/2000 Ellion
6,116,472 A 9/2000 Wanbaugh et al.
6,364,172 B1 4/2002 Maas et al.
6,378,739 B1 4/2002 Maas et al.
6,543,654 B1 4/2003 Uhl et al.
6,659,311 B2 12/2003 Prueter
6,669,061 B2 12/2003 Tada
6,789,303 B2 9/2004 Maas et al.
6,820,769 B2 11/2004 Foster et al.
7,455,198 B2 11/2008 Foster et al.
7,490,743 B2 2/2009 Herzog
7,497,358 B2 3/2009 Clynes et al.
7,571,836 B2 8/2009 Foster et al.
7,637,396 B2 12/2009 Foster et al.
7,712,636 B2 5/2010 Foster et al.
7,938,299 B2 5/2011 Fahy et al.
8,038,040 B2 10/2011 Dennis
8,066,155 B2 11/2011 Tada
8,074,826 B2 12/2011 Cronin et al.
8,408,429 B2 4/2013 Dennis
8,870,033 B2 * 10/2014 Alluigi ..... B05B 15/30 222/340
8,931,668 B2 1/2015 Alluigi et al.
D750,333 S 2/2016 Kane
9,339,830 B2 5/2016 De Roo
9,827,581 B2 11/2017 Good et al.
2002/0066802 A1 * 6/2002 Tada ..... B05B 11/3074 239/333
2006/0086759 A1 4/2006 Herzog
2006/0086762 A1 4/2006 Foster et al.
2006/0289679 A1 12/2006 Johnson et al.
2007/0290005 A1 * 12/2007 Foster ..... B05B 11/3077 222/383.1
2008/0093476 A1 4/2008 Johnson et al.
2008/0121664 A1 5/2008 Ophardt et al.
2009/0212077 A1 8/2009 Carden
2010/0096414 A1 * 4/2010 Dennis ..... B05B 11/0056 239/526
2010/0096415 A1 * 4/2010 Dennis ..... B05B 15/30 222/464.1
2010/0133358 A1 6/2010 Gohring
2011/0036927 A1 * 2/2011 Hensen ..... B05B 15/652 239/302
2011/0049191 A1 3/2011 Crawford et al.
2011/0108447 A1 * 5/2011 Hoefing ..... B05B 11/001 206/459.5
2011/0108581 A1 * 5/2011 Dennis ..... B05B 11/3045 222/464.1
2012/0006856 A1 1/2012 Dennis
2012/0018458 A1 * 1/2012 Chernik ..... B05B 11/0037 222/383.1
2012/0241474 A1 9/2012 Dennis
2013/0161359 A1 * 6/2013 Alluigi ..... B05B 11/0008 222/383.1
2014/0224842 A1 * 8/2014 Alluigi ..... B05B 15/30 222/380
2016/0059254 A1 3/2016 De Roo
2018/0105330 A1 * 4/2018 Lorio ..... B65D 41/17

FOREIGN PATENT DOCUMENTS

WO 2010026326 A1 3/2010
WO 2015068065 A1 5/2015

OTHER PUBLICATIONS

Unsolicited letter received from George T. Schoof, Esq. of Harness, Dickey & Pierce, PLC dated Apr. 26, 2013 and related to U.S. Appl. No. 13/068,875.
Unsolicited letter received from George T. Schoof, Esq. of Harness, Dickey & Pierce, PLC dated Apr. 26, 2013 and related to U.S. Appl. No. 13/408,499.
Mexican Office Action regarding Mexican Patent Application No. MX/a/2017/013208, dated Feb. 4, 2022.

* cited by examiner

DIP TUBE CONNECTORS AND PUMP SYSTEMS USING THE SAME

CROSS-REFERENCE TO RELATED APPLICATIONS

This application is a continuation of U.S. application Ser. No. 16/579,710 filed Sep. 23, 2019, which is a continuation of U.S. application Ser. No. 15/206,758, filed Jul. 11, 2016, now U.S. patent Ser. No. 10/421,090 issued Sep. 24, 2019, which is a divisional application of U.S. application Ser. No. 14/341,951, filed Jul. 28, 2014, now U.S. Pat. No. 9,387,500 issued Jul. 12, 2016, which is a divisional application of U.S. application Ser. No. 13/285,576, filed on Oct. 31, 2011, now U.S. Pat. No. 8,800,822, issued Aug. 12, 2014, which is a continuation-in-part of U.S. application Ser. No. 13/068,875 filed on Mar. 15, 2011 as U.S. Provisional Application No. 61/452,854 and for which a Request to Convert to a Non-Provisional application was filed on Oct. 31, 2011, now U.S. Pat. No. 9,827,581 issued Nov. 28, 2017. The entire disclosures of each of the above applications are incorporated herein by reference.

FIELD

The present disclosure relates to dip tube connectors and dip tube connection systems for connecting pumps with containers or bottles having dip tubes integrated therewith.

BACKGROUND

This section provides background information related to the present disclosure which is not necessarily prior art.

Conventional pump spray systems, such as trigger sprayers or fine mist sprayers, typically employ dip tubes as a means for transporting fluid or product from an interior of a container or bottle to the pump sprayer. While the use of dip tubes is predominant in the industry, there have been attempts to eliminate the dip tube. For example, U.S. Pat. No. 4,863,071, which is incorporated herein by reference, discloses a container and pump unit where the container is formed with an integral liquid supply tube in lieu of a dip tube. Similarly, United States Patent Application 2010/0096415A1, which is incorporated herein by reference, discloses a fluid dispensing container having a bottle and fluid withdrawing assembly for liquids wherein the bottle includes an integral dip tube and the fluid dispensing mechanism may be aligned to allow a direct connection between the integral dip tube and the fluid dispensing mechanism. In each of these examples, the connection between the blown-in dip tube of the bottle or container and the pump spray systems appear to be simple tubes. For instance, the trigger supply lines (34 and 46) described and illustrated in U.S. Patent App. 2010/0096415A1 appear to be nothing more than a tube which slides into a blown-in dip tube.

While the simple engagement of a trigger supply line with a blown-in dip tube may be useful, there may be other instances where more robust fitments between a blown-in dip tube and pump system are needed. In addition, configurations or adaptations which may allow a container or bottle having a blown-in dip tube to be fitted with a traditional trigger sprayer or pump system may be advantageous. Furthermore, improvements in a fitment between a pump sprayer system and a blown-in dip tube may be advantageous.

SUMMARY

This section provides a general summary of the disclosure, and is not a comprehensive disclosure of its full scope or all of its features.

According to certain embodiments of the invention, a pump system for pumping a liquid through a container or a bottle having a blown-in dip tube may include an improved blown-in dip tube connector. An improved blown-in dip tube connector may include a flexible blown-in dip tube connector. An improved blown-in dip tube connector may also be configured to snap fit or otherwise attach to a valve body of a pump system, to a valve retainer of a pump system, or to a combination of a valve retainer and valve body. In some embodiments, a connection between the blown-in dip tube connector and a blown-in dip tube of a bottle or container may include one or more features configured to retain the blown-in dip tube connector in a blown-in dip tube or to improve a seal between the blown-in dip tube connector and a blown-in dip tube.

For instance, according to certain embodiments of the invention, a blown-in dip tube connector may include a fluid inlet at one end configured to mate with a blown-in dip tube. The blown-in dip tube connector may include one or more dip tube lips configured to mate with a portion of the blown-in dip tube and to provide an improved seal between the blown-in dip tube and blown-in dip tube connector.

In other embodiments of the invention, a blown-in dip tube connector may include one or more seal rings configured to facilitate a seal between a blown-in dip tube connector and a blown-in dip tube when the blown-in dip tube connector is mated with a blown-in dip tube. The one or more seal rings may sit on a seat formed in the blown-in dip tube and may be further retained in position by lips, detents, or other features configured to facilitate a sealed connection between the blown-in dip tube connector and blown-in dip tube. According to certain embodiments of the invention, a seal ring may be bi-injected with the blown-in dip tube connector or may be formed or attached to the blown-in dip tube connector during an assembly process. In some embodiments of the invention, a seal ring material may include a plastic, elastomer, or flexible material. In some embodiments, for example, a seal ring may be made of a thermoplastic elastomer, a thermoplastic urethane or polyurethane, silicon, rubber, or other material.

In still other embodiments of the invention, a blown-in dip tube connector may include one or more dip tube locks which may mate with a detent, lip, or other feature of a blown-in dip tube. A dip tube lock may include a recess, lip, or combination thereof formed in a portion of the blown-in dip tube connector near a fluid inlet thereof. The recess, lip, or combination may be configured to snap lock with a feature on a blown-in dip tube.

In still other embodiments of the invention, a blown-in dip tube connector having one or more dip tube locks may also be fitted with an o-ring or other feature to secure a fluid inlet of the blown-in dip tube connector with a blown-in dip tube. For instance, an o-ring may be seated about a dip tube lock such that when the fluid inlet end of a blown-in dip tube connector is inserted in a blown-in dip tube of a container or bottle, the o-ring may form a seal with the sides of the blown-in dip tube. The seal formed between an o-ring and the side of the blown-in dip tube may provide an improved seal between the blown-in dip tube connector and the blown-in dip tube.

According to various embodiments of the invention, a blown-in dip tube connector may be made of a plastic material. For example, a blown-in dip tube connector may be molded using a high-density polyethylene or medium-density polyethylene. Other materials may also be used as desired.

In various embodiments of the invention, a blown-in dip tube connector may be attached to, or assembled with, a pump system in any number of ways. In some embodiments, for example, a blown-in dip tube connector may include one or more connector lips which may mate with one or more connectors of a valve body to secure the blown-in dip tube connector to the valve body. In other embodiments of the invention, a blown-in dip tube connector may be mated with a valve retainer, or ball retainer, such that the blown-in dip tube connector and valve retainer form a unitary part that may be assembled with a valve body. In such instances, the valve body may be configured to secure the valve retainer, the blown-in dip tube connector, or both.

According to certain embodiments of the invention, a pump system may include a one piece blown-in dip tube connector connected to a valve body of a trigger sprayer and to a blown-in dip tube of a bottle. The one piece blown-in dip tube connector may provide a fluid path between a blown-in dip tube and a trigger sprayer. A one piece blown-in dip tube connector may retain a valve, such as a ball or other type of valve, in a valve body of a trigger sprayer and may be connected thereto. The one piece blown-in dip tube connector may also include a port which may be connected to a blown-in dip tube of a bottle and may fluidly seal with the blown-in dip tube such as with a seal ring, a dip tube lock, an o-ring, a dip tube lip, flange, or other sealing feature.

According to still other embodiments of the invention, a blown-in dip tube connector may include a flexible tube which may act as a direct connection between a blown-in dip tube in a bottle and a trigger sprayer. In some embodiments of the invention, one end of a flexible tube—such as a flexible dip tube—may be inserted into a trigger sprayer or tube retainer of a trigger sprayer in a conventional manner. The opposite end may be inserted into a blown-in dip tube of a bottle and the trigger sprayer connected to the bottle, such as through a conventional bayonet connection or threaded screw connection. The opposite end may seal against or with the blown-in dip tube such that a fluid path is formed between the blown-in dip tube and the trigger sprayer. The flexible tube may bend, curve, or otherwise be positioned such that the connection between the blown-in dip tube and the trigger sprayer is accomplished regardless of whether or not the blown-in dip tube opening and the fluid supply line to the trigger sprayer are in alignment or are offset.

According to other embodiments of the invention, a funnel may be used with a pump system. A funnel may be positioned in a bottle having a blown-in dip tube such that a path to an opening in the blown-in dip tube is created. Assembly of a trigger sprayer having a flexible dip tube to the bottle may then be accomplished in an in-line position such that the trigger sprayer may be assembled in a straight line with the bottle. During assembly, a flexible dip tube will encounter the funnel and be guided into the opening of the blown-in dip tube where a fluid tight seal may be achieved, connecting the blown-in dip tube to the trigger sprayer through the flexible dip tube. In some embodiments of the invention, a funnel may also include one or more openings or slots in the funnel such that a bottle may be filled or refilled through the funnel.

According to still other embodiments of the invention, a blown-in dip tube connector may include a swivel adapter, or rotatable connector, which creates a fluid path from a blown-in dip tube of a bottle to a trigger sprayer. In some embodiments of the invention, a swivel adapter may include a body or head which may be attached to a valve body, tube retainer, or valve retainer of a trigger sprayer. A port may extend away from the head or body of the swivel adapter and may be configured to mate with and seal in an opening of a blown-in dip tube of a bottle. The swivel adapter may be configured such that the swivel adapter can rotate relative to a trigger sprayer to which it is attached so that rotation of the trigger sprayer—for example to remove it from a bottle—will not rotate the swivel adapter when connected to a blown-in dip tube. The rotational feature of the swivel adapter with respect to the trigger sprayer, allows a trigger sprayer to be connected and disconnected to a bottle having a blown-in dip tube on repeated occasions so that the bottle may be refilled as desired.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

According to various embodiments of the invention, a blown-in dip tube connector may be fitted to, integrated with, or otherwise assembled with a pump sprayer to facilitate the use of the pump sprayer with a container or bottle having a blown-in dip tube. The integration or fitment of the blown-in dip tube connector with a pump sprayer may allow the pump sprayer to be removed from the container or bottle. The integration or fitment of the blown-in dip tube connector with a pump sprayer may also allow the pump sprayer to be removed from the container or bottle and then refitted to the container or bottle as desired. Thus, various embodiments of the invention may be used with pump systems designed to be used on refillable bottles or containers.

Figure 1:
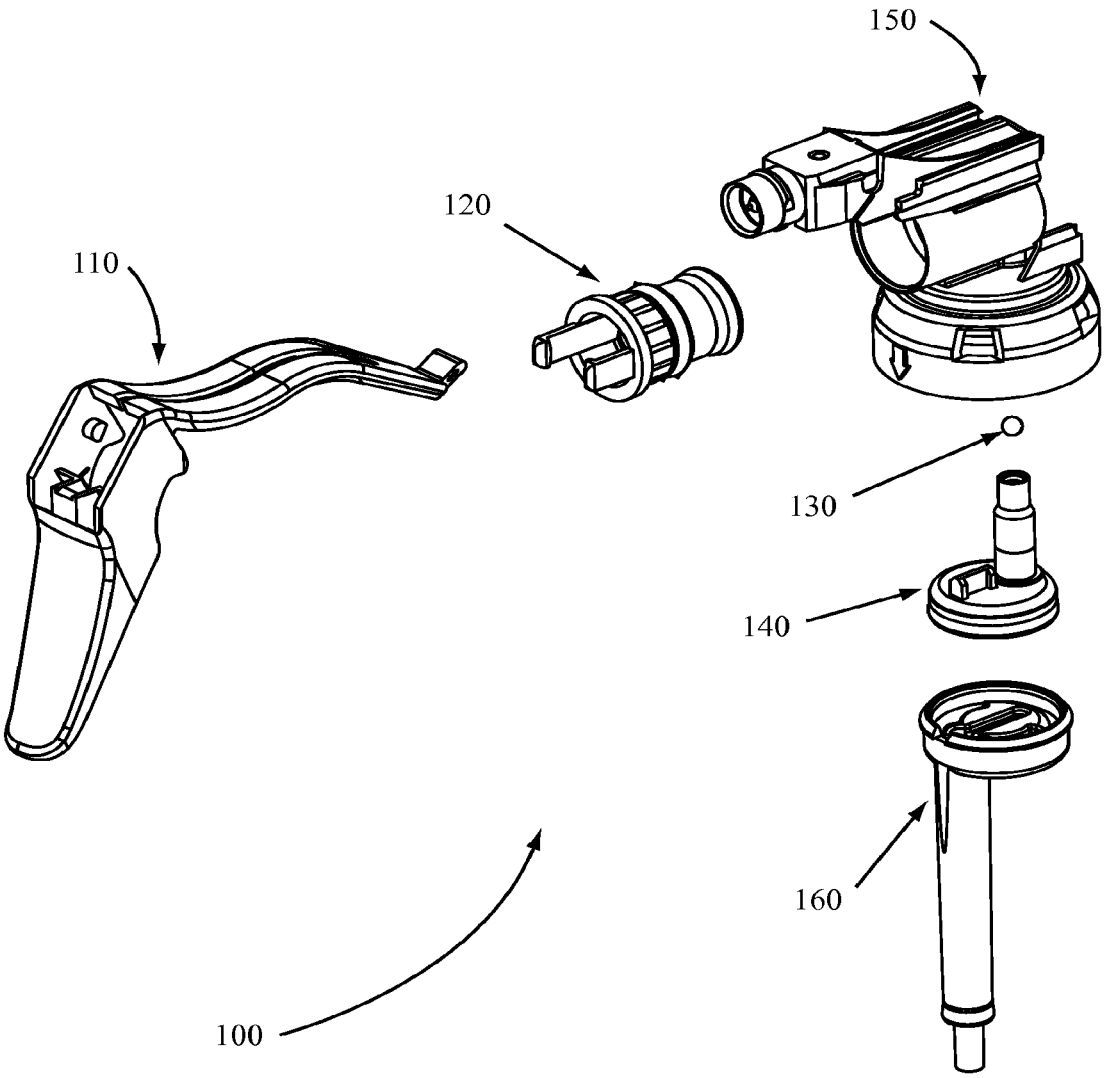
FIG. 1 illustrates various components of a pump system according to embodiments of the invention.

A pump system 100 according to various embodiments of the invention is illustrated in FIG. 1. As illustrated, a pump system 100 may include a trigger sprayer system. The trigger sprayer, or pump system 100, illustrated in FIG. 1 may include a valve body 150, a piston 120, an integrated trigger and spring 110, a ball valve 130, a ball retainer 140 and a blown-in dip tube connector 160. The pump system 100 may also include a container 900 or bottle having a blown-in dip tube 960 and the container 900 may include a product therein.

Figure 2:
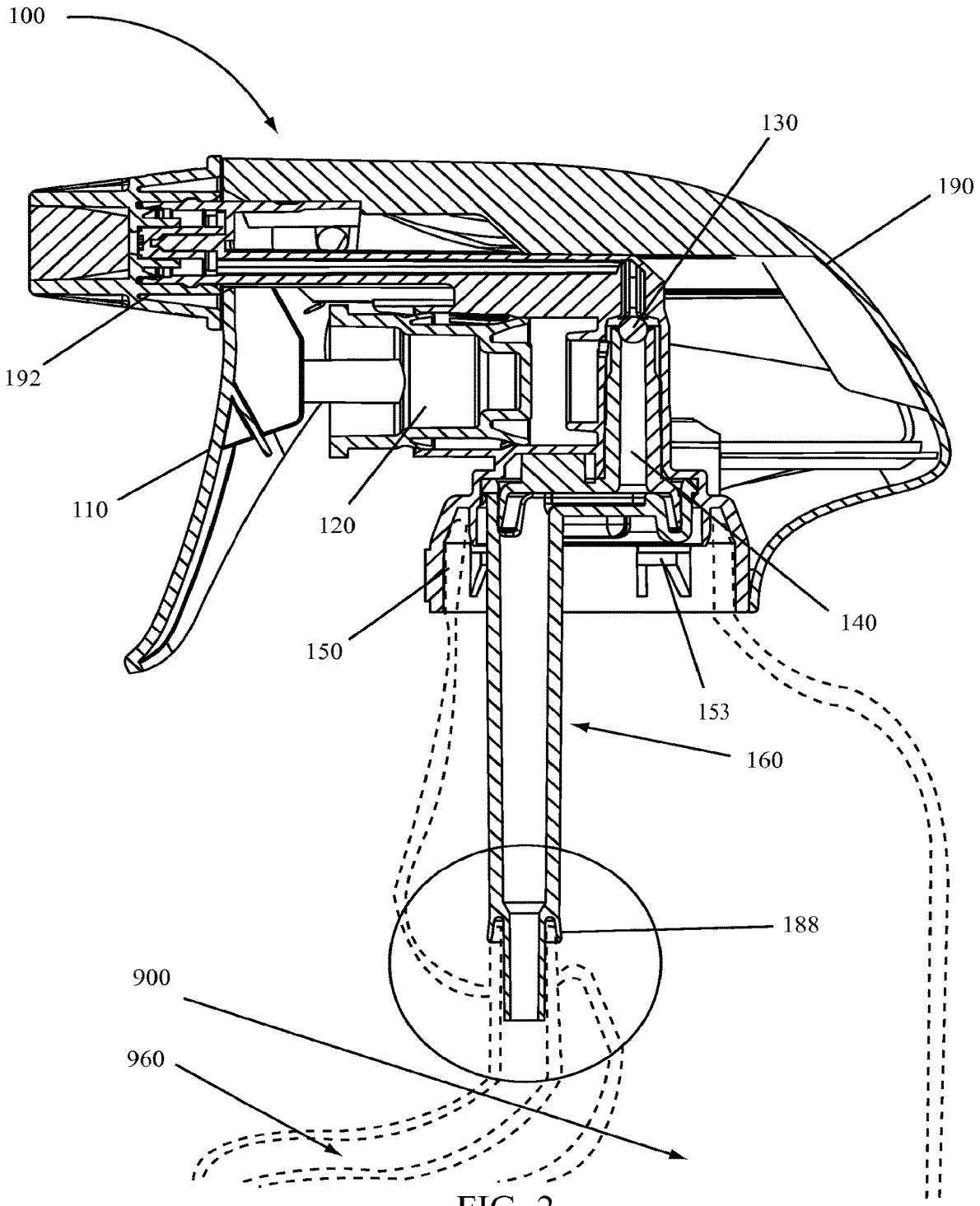
FIG. 2 illustrates a cross-sectional view of a trigger sprayer pump system according to various embodiments of the invention.

A cross-sectional view of an assembled pump systems 100 according to various embodiments of the invention is illustrated in FIG. 2. A container or bottle 900 having a blown-in dip tube 960 is illustrated in dashed lines for reference. While a particular bottle 900 shape and blown-in dip tube 960 configurations are illustrated, embodiments of the invention are not limited by the illustrated shapes and configurations, and embodiments of the invention may be used with any container or bottle 900 having a blown-in dip tube 960. Further, any conventional or known bottles 900 having blown-in dip tubes 960 may be used with the various embodiments of the invention and the blown-in dip tubes 960 may include openings which are flush with an opening in the bottle 900 or which are recessed below an opening in the bottle 900 as known.

As illustrated in FIG. 2, the pump system 100 according to embodiments of the invention may include a trigger sprayer having a valve body 150, a ball valve 130 and a ball retainer 140 assembled in an interior space of the valve body 150, and a blown-in dip tube connector 160 in communication with the ball retainer 140. A pump system 100 may also include a shroud 190 and a nozzle 192. An integrated trigger and spring 110 may be assembled such that the piston 120 may be actuated by actuation of the trigger portion of the integrated trigger and spring 110. In other embodiments of the invention, an integrated trigger and spring 110 may be substituted by separate trigger and spring components wherein the separate spring component may bias either the separate trigger component or piston to allow return movement of the piston following an actuation of the pump system 100. For example, a conventional metal or plastic spring and trigger system may be used with embodiments of the invention in place of an integrated trigger and spring 110.

A valve body 150 for a pump system 100 according to embodiments of the invention may include any conventional valve body. Examples of valve bodies 150 which may be used with various embodiments of the invention are illustrated in FIGS. 1, 2, 18 through 21, and 27. As illustrated, a valve body 150 may include a bayonet connection system 153 for connecting the valve body 150 or pump system 100 to a bottle. For instance, a bayonet connection system such as that described in U.S. Pat. No. 5,845,820, which is incorporated herein by reference in its entirety, may be used with embodiments of the invention. Other bayonet or snap-on type connector systems may also be used with embodiments of the invention. Alternatively, a valve body 150 may include a conventional threaded screw system (not shown) wherein a threaded connection element may be assemble to or with the valve body such that the valve body 150 may be connected and sealed to a bottle or container. In some instances, where a threaded closure system is used, a retainer seal or retainer ring may also be used to assure that the connection between a container or bottle and the valve body 150 does not leak.

A valve body 150 used with embodiments of the invention may include a vent. According to some embodiments, a vent may include a vent connection 152 as illustrated in FIGS. 18 through 21. The vent connection 152 may connect an interior portion of a piston chamber 151 with an interior portion of the valve body 150 which is in communication with the interior of a bottle or container when the pump system 100 is connected thereto. When a piston 120 passes a certain location within the piston chamber 151, air may pass through the vent connection 152 and into the container or bottle.

A valve body 150 may also include a fluid passageway 156. According to some embodiments of the invention, fluid passing through a blown-in dip tube connector 160 may pass into the fluid passageway 156 and into the piston chamber 151. In other embodiments of the invention, a fluid passageway 156 may be configured to accept and hold or retain a ball retainer 140 assembled with the valve body 150. In such instances, fluid passing from a container through the blown-in dip tube connector 160 may pass through that portion of the ball retainer 140 assembled in the fluid passageway 156.

Figure 26:
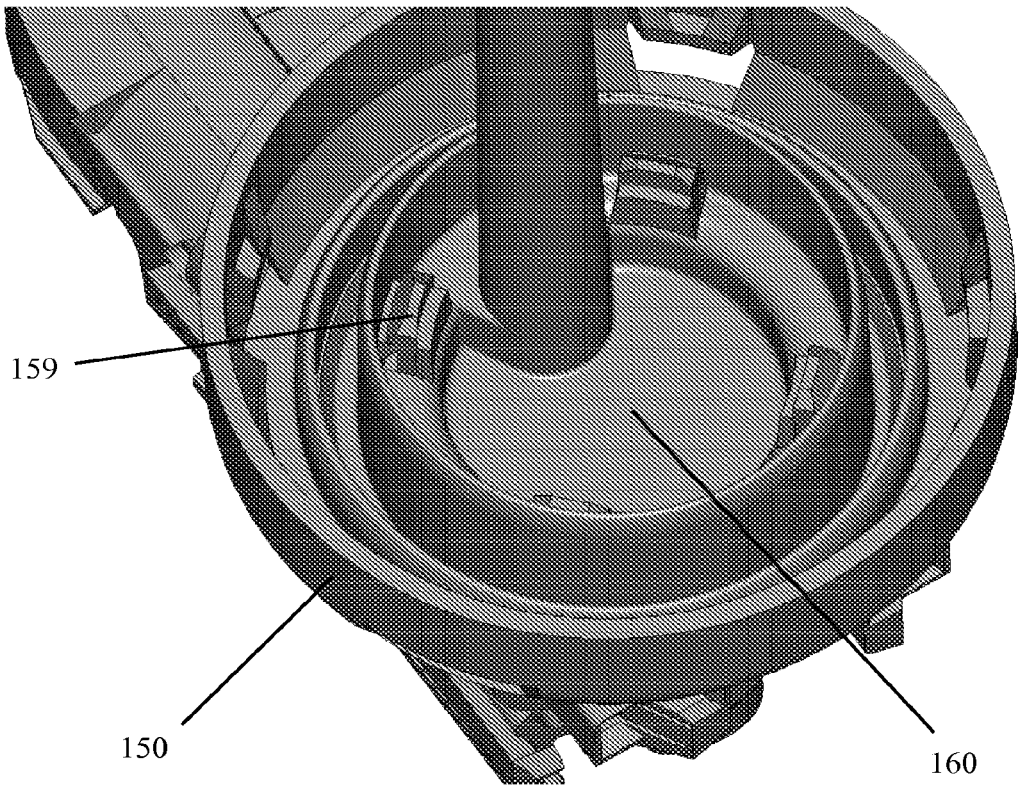
FIG. 26 illustrates a valve body according to various embodiments of the invention having one or more latches.

In some embodiments of the invention, a valve body 150 may include one or more connectors 159. The one or more connectors 159 may be configured to mate with, snap with, fix, or otherwise retain a blown-in dip tube connector 160 with the valve body 150. In some embodiments, the one or more connectors 159 may fit with corresponding features of a blown-in dip tube connector 160 such that the blown-in dip tube connector 160 is maintained in a fixed position with respect to the valve body 150. In other embodiments of the invention, the one or more connectors 159 may fit with corresponding features of a blown-in dip tube connector 160 such that the blown-in dip tube connector 160 may rotate or swivel relative to the valve body 150. For example, the one or more connectors 159 may include a snap ring configured to retain one or more connector lips 165 or connector tabs 175. In other instances, the one or more connectors 159 may include one or more latches as illustrated in FIG. 26.

According to various embodiments of the invention, a valve for the pump system 100 may include a ball valve 130 moveably fixed on an interior of the valve body by a ball retainer 140 as illustrated in FIG. 2. A ball valve 130 may be assembled in a portion of the fluid passageway 156 of a valve body and a ball retainer 140 may be fitted in a portion of the fluid passageway 156 such that the ball valve 130 is retained in the valve body 150. In some embodiments of the invention, the ball retainer 140 may be snap fitted into a fluid passageway 156 portion of the valve body 150. In other embodiments, the ball retainer 140 and valve body 150 may include complimentary fasteners or features for holding and retaining the ball retainer 140 within a fluid passageway 156 of the valve body 150. In still other embodiments of the invention, a ball retainer 140 may include one or more seal rings which may mate with or seal with an interior portion of a blown-in dip tube retainer 160 such that the blown-in dip tube retainer 160 and ball retainer 140 may be assembled as a single piece and then assembled with a valve body 150 wherein either the blown-in dip tube connector 160 or ball retainer 140 mate with or connect to the valve body 150.

In some embodiments of the invention, the ball retainer 140 may also be configured as a dip tube retainer such that a conventional dip tube may be retained by the ball retainer 140 as well. In such configurations, a blown-in dip tube connector 160 would not be utilized. However, the option to dual purpose a ball retainer 140 as both a retainer for the ball valve 130 and as a dip tube retainer may allow a single part to be made for pump systems 100 being used with both traditional dip tube systems and for systems employing containers or bottles having blown-in dip tubes.

While various embodiments of the invention are illustrated with a ball valve 130, it is understood that other valve systems may be incorporated with various embodiments of the invention. For example, a double valve element as described in U.S. Pat. No. 6,641,003, which patent is incorporated herein by reference in its entirety, may be employed with various embodiments of the invention. In such embodiments, the double valve element may be positioned and retained in the fluid passageway 156. In still other embodiments of the invention, a valve system such as that described and illustrated in U.S. Pat. No. 7,175,056, which patent is incorporated by reference herein in its entirety, may be used with a valve body 150 and the pump system 100 having a blown-in dip tube connector 160 may be configured appropriately to utilize such a valve system. In still other embodiments of the invention, a tube retainer having one or more integral valves as illustrated and described in WO2010/124040A2, which patent application is incorporated by reference herein in its entirety, may be used with various embodiments of the invention.

A pump system 100 according to various embodiments of the invention may also include a shroud 190 attached to the valve body 150 or other portion of the pump system 100 as conventionally known. In addition, the pump system 100 may include a nozzle 192 fitted to the valve body 150 as conventionally known.

According to various embodiments of the invention, a pump system 100 may include a blown-in dip tube connector 160. Various configurations for blown-in dup tube connections are illustrated in the Figures.

A blown-in dip tube connector 160 according to various embodiments of the invention is illustrated in FIGS. 3 through 8. As illustrated, the blown-in dip tube connector 160 may include a fluid inlet 161, a fluid flow path 162, and a connector head 164. The fluid flow path 162 may be bounded on either end by the inlet 161 and an outlet 167. During operation of a blown-in dip tube connector 160, fluid may pass from a blown-in dip tube through the inlet 161 into the fluid path 162 and out the outlet 167 into a fluid flow chamber 166 in the connector head 164. Fluid passing into the fluid flow chamber 166 may pass into a ball retainer 140 and be pumped through the pump system 100.

According to certain embodiments of the invention, a blown-in dip tube connector 160 may include one or more connector lips 165 about a periphery of a connector head 164 as illustrated in FIGS. 3 through 8. A connector lip 165 may be configured to snap-fit or otherwise mate with one or more connectors 159 on a valve body 150 such that the blown-in dip tube connector 160 may be fitted with or retained with a valve body 150. In some embodiments of the invention, the fitment of the one or more connector lips 165 with a connector 159 of a valve body 150 may allow movement of the blown-in dip tube connector 160, such as a swiveling movement. In other embodiments, the fitment of the one or more connector lips 165 with the valve body 150 may hold the blown-in dip tube connector 160 in a fixed position with respect to the valve body 150. When a blown-in dip tube connector 160 is fitted to a valve body 150, the blown-in dip tube connector 160 may also mate with or seal with a ball retainer 140 or tube retainer. The positioning of the blown-in dip tube 160 with the ball retainer 140 may be such that the connector head 164 and ball retainer 140 may be sealed together such that fluid passing through the fluid flow chamber 166 will not leak.

According to some embodiments of the invention, the blown-in dip tube connector 160 may also include one or more seal rings 163 which may mate with, contact, or otherwise facilitate a fluid tight seal between the blown-in dip tube connector 160 and a blown-in dip tube of a bottle or container. As a comparison, prior art having tubes which are inserted or snapped directly into a blown-in dip tube may not make a sufficient seal with the blown-in dip tube. In such instances, the necessary vacuum between a pump system and the blown-in dip tube may be lost, which may result in a loss of prime for the pump system. In other instances, the loss of prime may not be recoverable if a seal between a tube and a blown-in dip tube is lost. Thus, the inclusion of one or more seal rings 163 on a blown-in dip tube connector may improve the seal of the blown-in dip tube connector 160 with a blown-in dip tube. The improved seal between the blown-in dip tube connector 160 and a blown-in dip tube may result in improved functionality and reliability of a pump system 100 utilizing a blown-in dip tube container or bottle. In addition, the inclusion of one or more seal rings 163 with embodiments of the invention allows a more robust and repeatable seal between the blown-in dip tube connector and a blown-in dip tube when pump systems 100 according to embodiments of the invention are used with refillable bottles or containers where the pump system 100 may be attached and detached from a container or bottle having a blown-in dip tube multiple times.

Figure 23A:
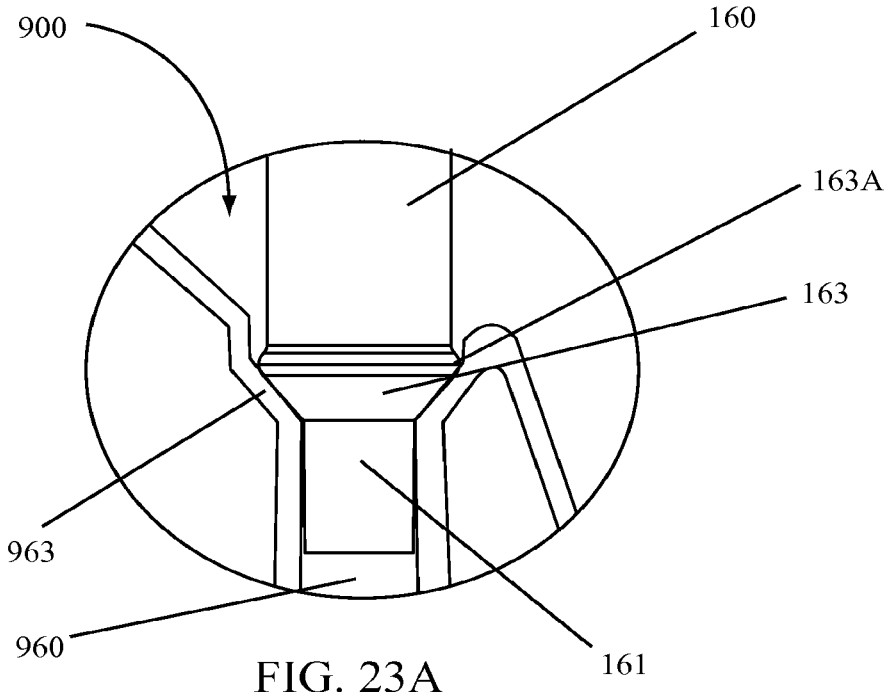
FIGS. 23A and 23B illustrate close-up views of a connection between the blown-in dip tube connector illustrated in FIG. 6 and a blown-in dip tube according to various embodiments of the invention.
Figure 23B:
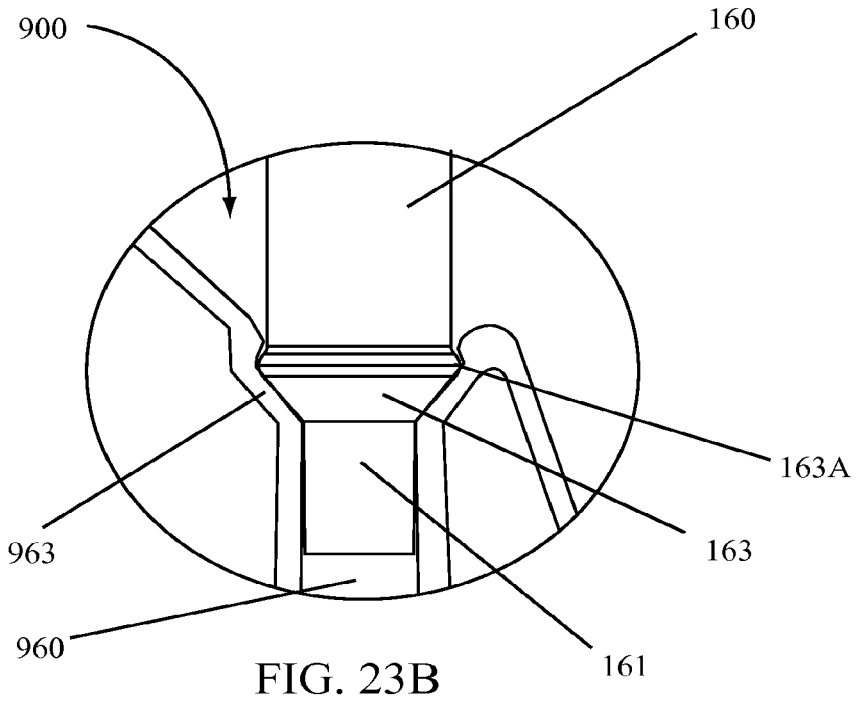

For example, a blown-in dip tube connector 160 mated with a blown-in dip tube 960 of a container or bottle 900 according to certain embodiments of the invention is illustrated in FIGS. 23A and 23B. As shown, a fluid inlet 161 portion of a blown-in dip tube connector 160 may be positioned in a blown-in dip tube 960 of a bottle 900. One or more seal rings 163 of the blown-in dip tube connector 160 may mate with or seal with a blown-in dip tube seat 963. According to some embodiments of the invention, the one or more seal rings 163 may include one or more lips 163A which may snap into one or more detents or snap fitments on a blown-in dip tube seat 963 to facilitate retention of the blown-in dip tube connector 160 with the blown-in dip tube 960 as illustrated in FIG. 23B. The one or more seal rings 163 may provide a fluid tight seal between the blown-in dip tube connector 160 and the blown-in dip tube 960 of a bottle 900.

Figure 3:
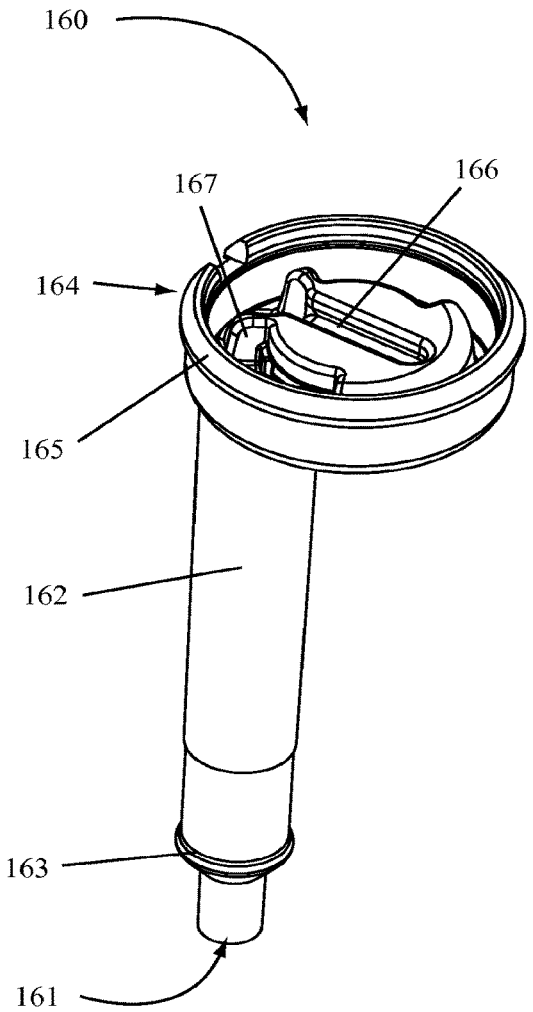
FIG. 3 illustrates a perspective view of a blown-in dip tube connector according to various embodiments of the invention.
Figure 4:
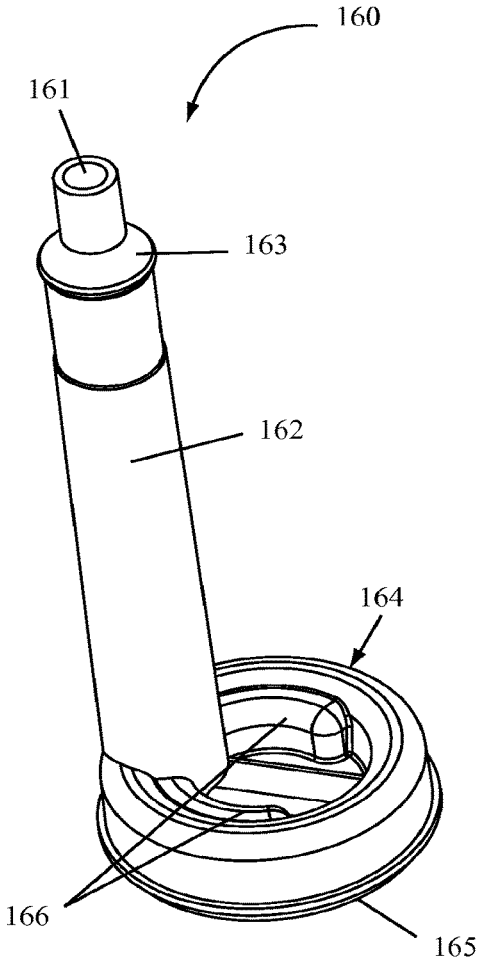
FIG. 4 illustrates a perspective view of a blown-in dip tube connector according to various embodiments of the invention.

As illustrated in FIGS. 3 and 4, the fluid inlet 161 portion of the blown-in dip tube 160 may have a smaller diameter than the flow path 162. In some embodiments, a smaller diameter in the fluid inlet 161 may facilitate a better seal between a blown-in dip tube connector 160 and a blown-in dip tube. For instance, as illustrated in FIG. 23A, the fluid inlet 161 may seat in a portion of the blown-in dip tube 960 such that a seal is formed between the outer circumference of the fluid inlet 161 and the inner circumference of the blown-in dip tube 960. The presence of the one or more seal rings 163 on the blown-in dip tube seat 963 may provide an improved seal for the pump system 100.

According to various embodiments of the invention, the one or more seal rings 163 may be made of any desirable material. For example, a seal ring may be made of a thermoplastic elastomer, a thermoplastic urethane or polyurethane, silicon, rubber, or other material. However, in many instances, selection of a material may be made such that the one or more seal rings 163 are compatible with a fluid flowing through the blown-in dip tube connector 160. In some embodiments, the one or more seal rings 163 may be bi-injected with the blown-in dip tube connector 160. In other embodiments, the one or more seal rings 163 may be sprayed on, glued, press-fit, or otherwise connected to a blown-in dip tube connector 160. In addition, in some embodiments a material compatible with the one or more seal rings 163 may be applied to the blown-in dip tube seat 963 to improve the seal between the one or more seal rings 163 and the blown-in dip tube seat 963.

Figure 5:
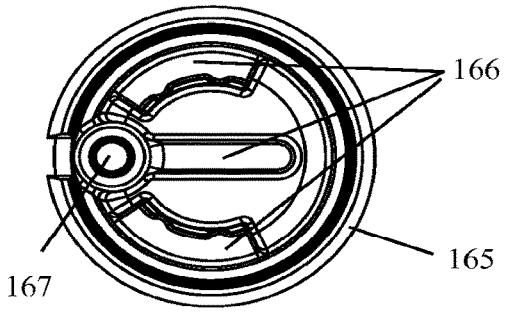
FIG. 5 illustrates a top view of a blown-in dip tube connector according to various embodiments of the invention.
Figure 6:
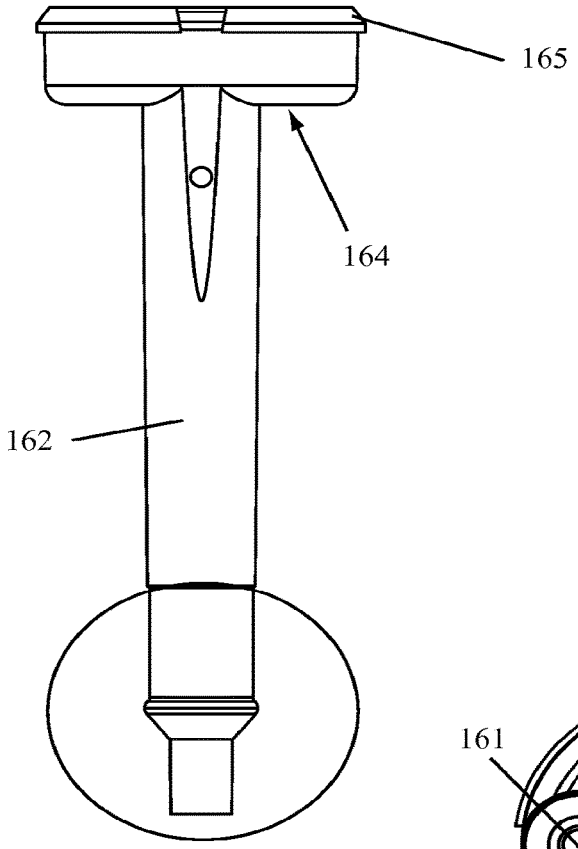
FIG. 6 illustrates a front view of a blown-in dip tube connector according to various embodiments of the invention.
Figure 7:
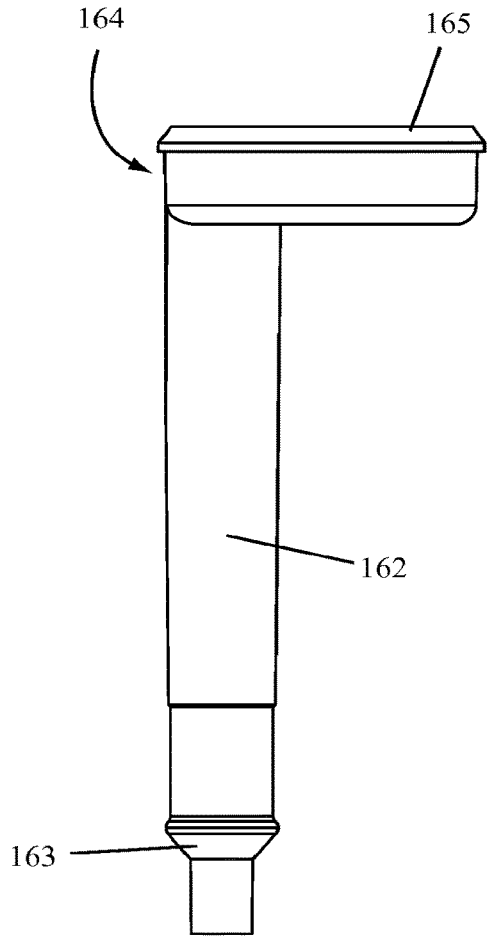
FIG. 7 illustrates a side view of a blown-in dip tube connector according to various embodiments of the invention.
Figure 8:
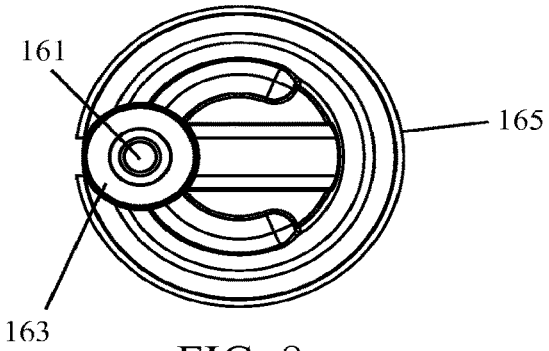
FIG. 8 illustrates a bottom view of a blown-in dip tube connector according to various embodiments of the invention.
Figure 9:
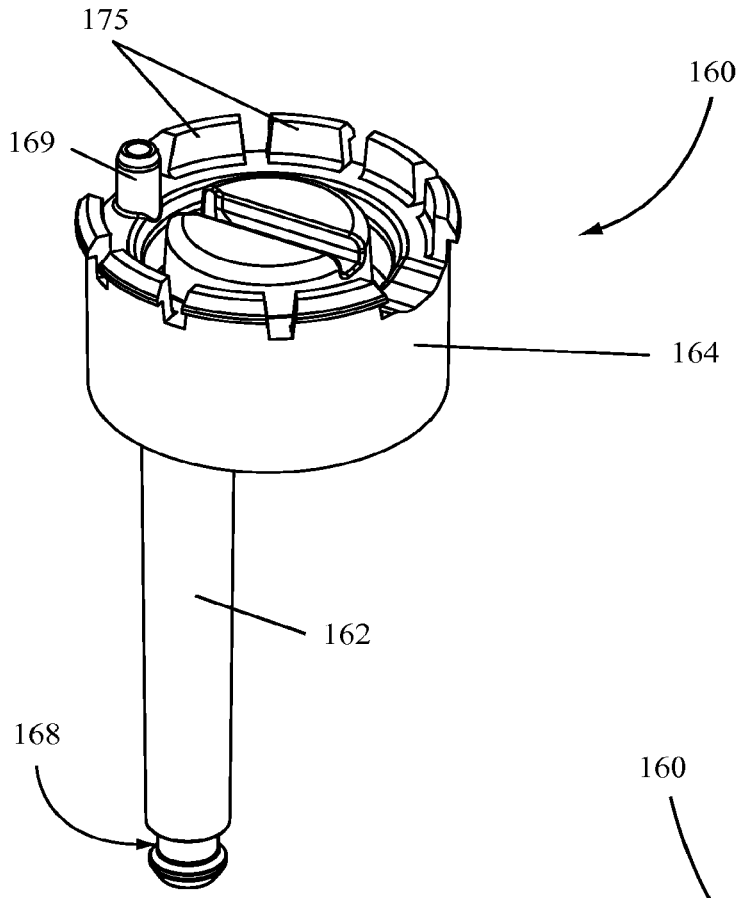
FIG. 9 illustrates a perspective view of a blown-in dip tube connector according to various embodiments of the invention.
Figure 10:
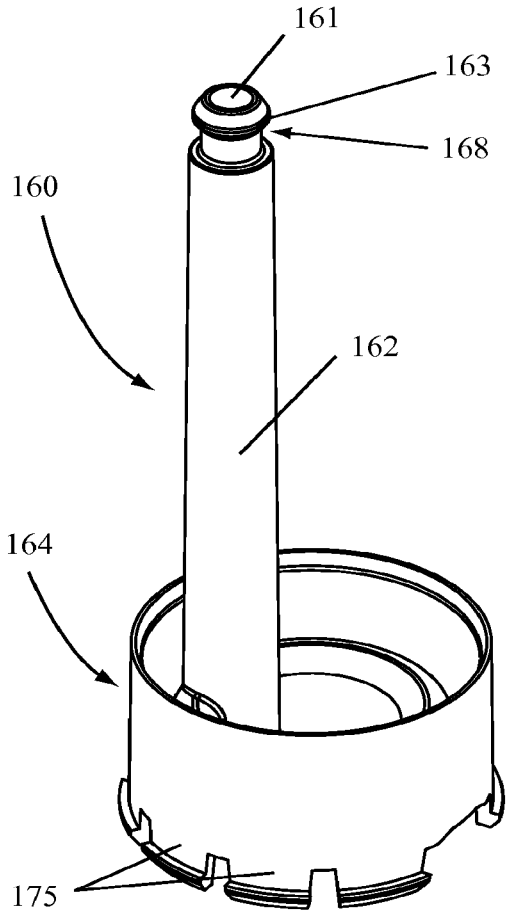
FIG. 10 illustrates a perspective view of a blown-in dip tube connector according to various embodiments of the invention.

A top view of a blown-in dip tube connector 160 is illustrated in FIG. 5. As illustrated, one or more connector lips 165 may rim at least a portion of the connector head 164. A fluid outlet 167 may open into a fluid flow chamber 166. While a particular shape and configuration for the fluid flow chamber 166 is illustrated, it is understood that other configurations could also be used. Front and side views of a blown-in dip tube connector 160 are illustrated in FIGS. 6 and 7 and a bottom view of the same illustrated in FIG. 8.

A blown-in dip tube connector 160 according to other embodiments of the invention is illustrated in FIGS. 9 through 15. As illustrated, a blown-in dip tube connector 160 may include a fluid inlet 161, a fluid flow path 162, and a connector head 164. The fluid flow path 162 may be bounded on either end by the inlet 161 and an outlet 167.

During operation of a blown-in dip tube connector 160, fluid may pass from a blown-in dip tube through the inlet 161 into the fluid path 162 and out the outlet 167 into a fluid flow chamber 166 in the connector head 164. Fluid passing into the fluid flow chamber 166 may pass into a ball retainer 140 and be pumped through the pump system 100. The blown-in dip tube connector 160 may also include one or more vent passages 169.

According to embodiments of the invention, a blown-in dip tube connector 160 as illustrated in FIGS. 9 through 15 may connect to a valve body 150, ball retainer 140 or both a valve body 150 and ball retainer 140 using the one or more connector tabs 175. The one or more connector tabs may mate with or fix to one or more connectors 159 on a valve body 150 or ball retainer 140. According to some embodiments of the invention, the one or more connector tabs 175 may include spacing between each of the one or more connector tabs 175 such that the one or more connector tabs 175 may flex during assembly of a blown-in dip tube connector 160 with a valve body 150, ball retainer 140, or both. Connection between the blown-in dip tube connector 160 and the valve body 150 or ball retainer 140 may be fixed or moveable.

According to various embodiments of the invention, a blown-in dip tube connector 160 may also include a dip tube lock 168 as illustrated in FIGS. 9 through 15. Unlike conventional blown-in dip tube connections, the inclusion of a dip tube lock 168 on a blown-in dip tube connector 160 may improve the sealing of the blown-in dip tube connector 160 with a blown-in dip tube. For example, a blown-in dip tube may include a detent, raised ridge, or other feature configured to mate with the dip tube lock 168. When inserted into a blown-in dip tube, the dip tube lock 168 may snap to or fit with a feature that helps to prevent removal of the blown-in dip tube 160 therefrom. In some embodiments of the invention, one or more seal rings 163 may also be combined with a dip tube lock 168 to improve the connection, seal, or connection and seal between a blown-in dip tube and a blown-in dip tube connector 160.

Figure 24:
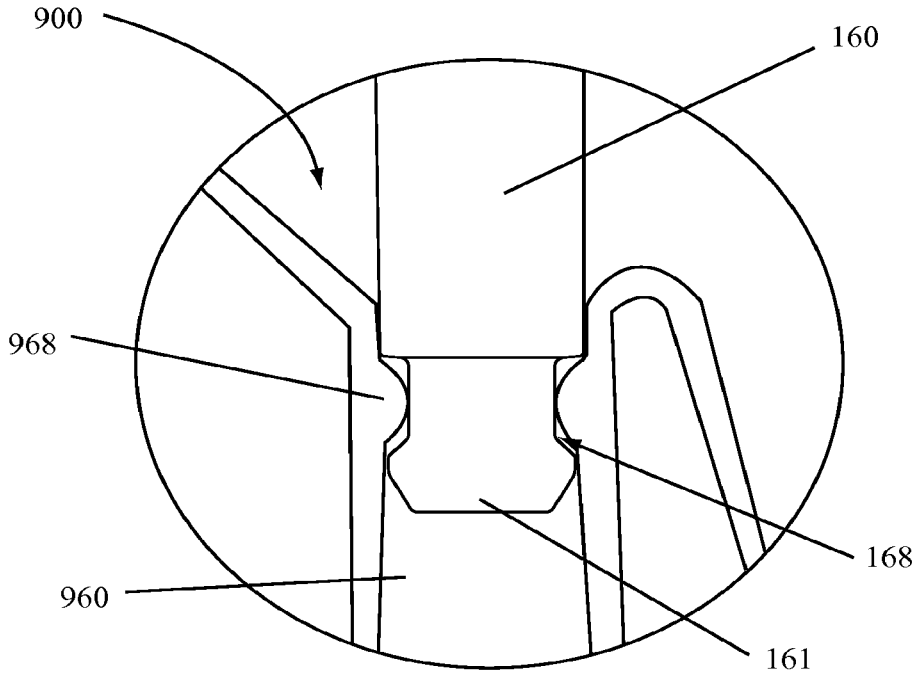
FIG. 24 illustrates a close-up view of a connection between the blown-in dip tube connector illustrated in FIG. 15 and a blown-in dip tube according to various embodiments of the invention.

An example of a connection between a blown-in dip tube 960 of a container or bottle 900 with a blown-in dip tube connector 160 having a dip tube lock 168 is illustrated in FIG. 24. In particular, FIG. 24 illustrates a detailed portion of the blown-in dip tube connector 160 circled in FIG. 15 in communication with a bottle 900. As illustrated, the dip tube lock 168 may snap fit with a detent 968, rim, or other feature of the blown-in dip tube 960 such that the blown-in dip tube connector 160 is secured to the blown-in dip tube 960. In some embodiments, the detent 968 and dip tube lock 168 may be configured such that once attached, the detent 968 and dip tube lock 168 will not separate without damaging the blown-in dip tube 960 or blown-in dip tube connector 160 such that they may not be reused. In other embodiments, the dip tube lock 168 and detent 968 may be configured to allow the blown-in dip tube connector 160 to be removed from the blown-in dip tube 960 and reassembled at a later time. For instance, such configuration may be desirable in those instances where a bottle 900 is to be re-filled and the pump system 100 reused with the bottle 900.

Figure 11:
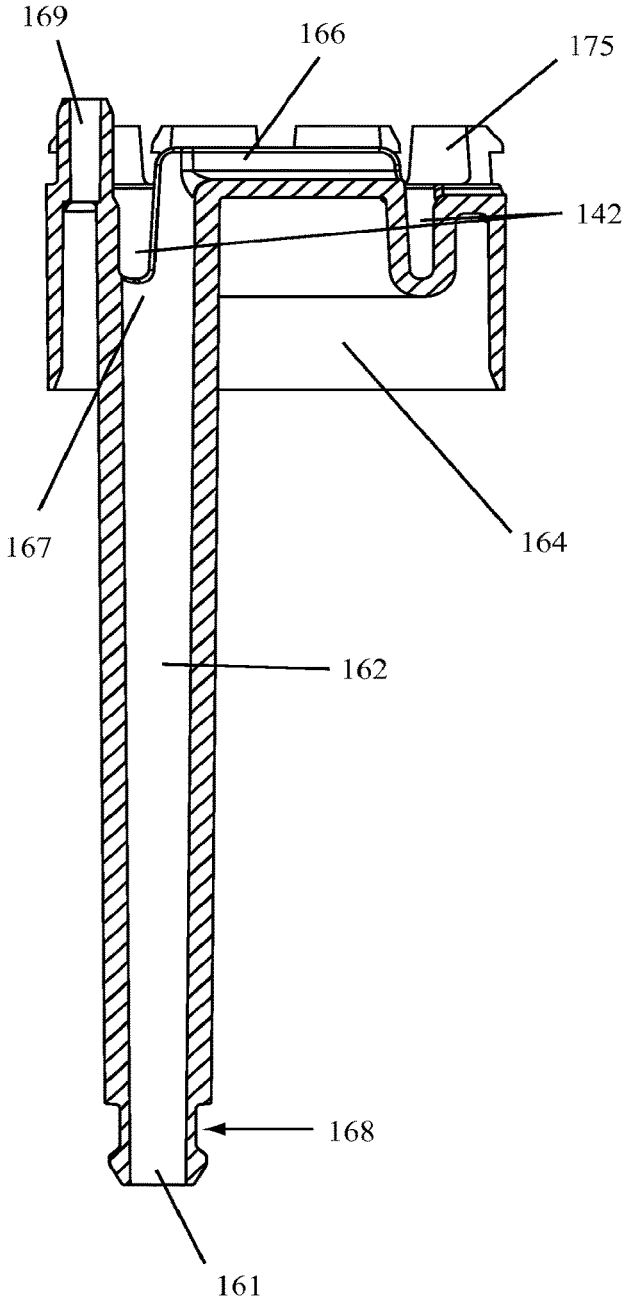
FIG. 11 illustrates a cross-sectional view of a blown-in dip tube connector according to various embodiments of the invention.
Figure 12:
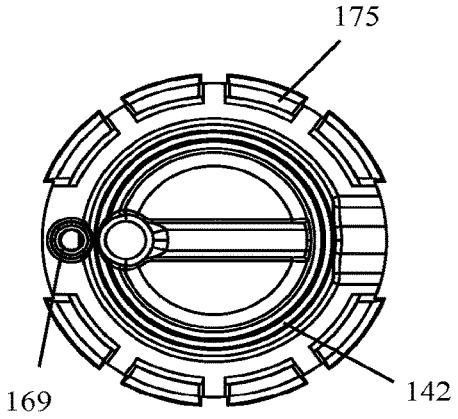
FIG. 12 illustrates a top view of a blown-in dip tube connector according to various embodiments of the invention.
Figure 13:
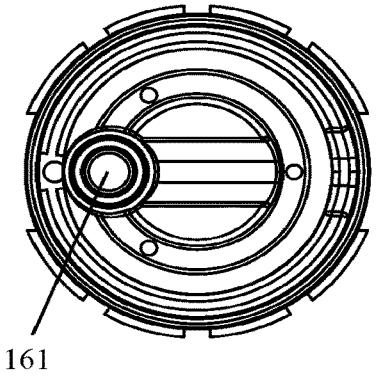
FIG. 13 illustrates a bottom view of a blown-in dip tube connector according to various embodiments of the invention.
Figure 14:
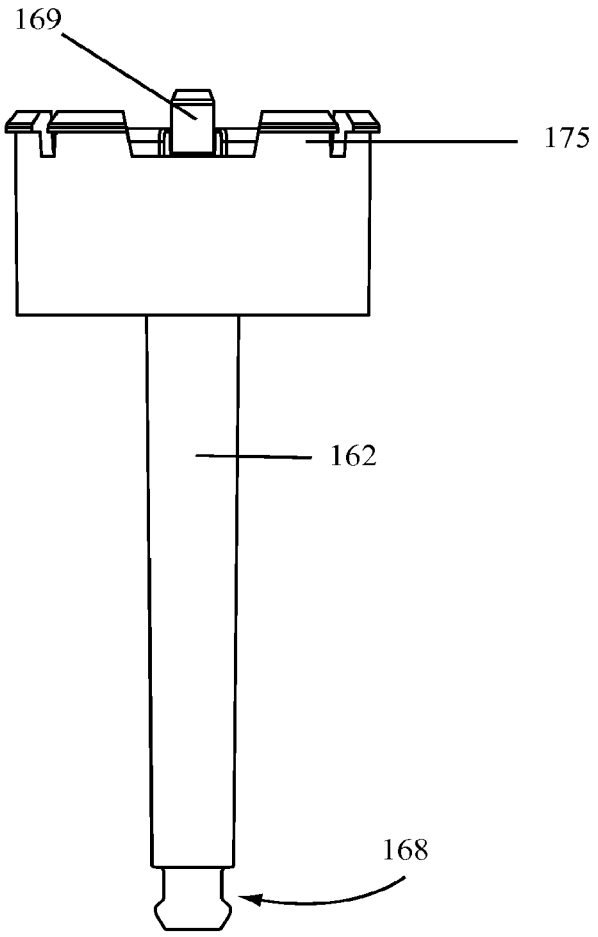
FIG. 14 illustrates a front view of a blown-in dip tube connector according to various embodiments of the invention.
Figure 15:
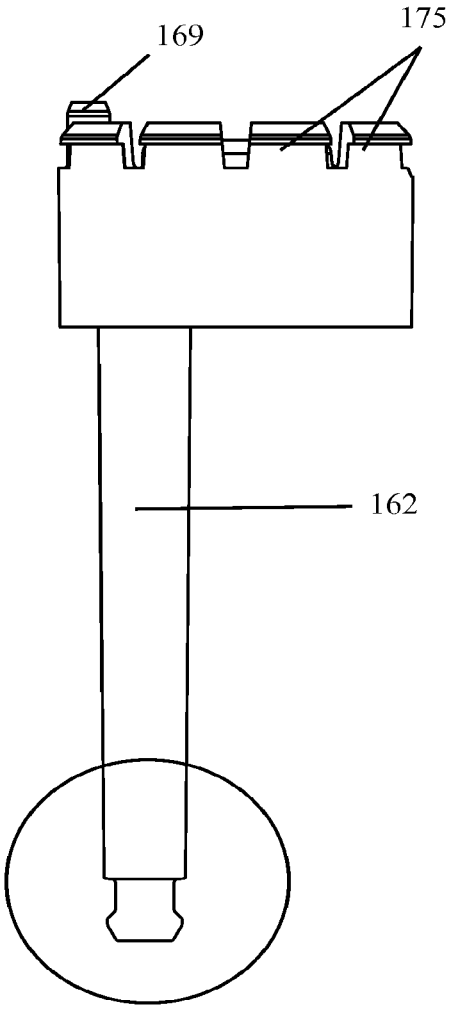
FIG. 15 illustrates a side view of a blown-in dip tube connector according to various embodiments of the invention.

As illustrated in FIGS. 11 and 12, a blown-in dip tube connector 160 may also include a trough 142 within at least a portion of the connector head 164. The trough may be configured to mate with, connect to, or otherwise seal with a ball retainer 140 as illustrated in FIG. 2. A ball retainer 140 may be snap fit into the blown-in dip tube connector 160 such that the blown-in dip tube 160 and ball retainer 140 may be shipped as a single unit or used as a single unit during an assembly process.

Figure 16:
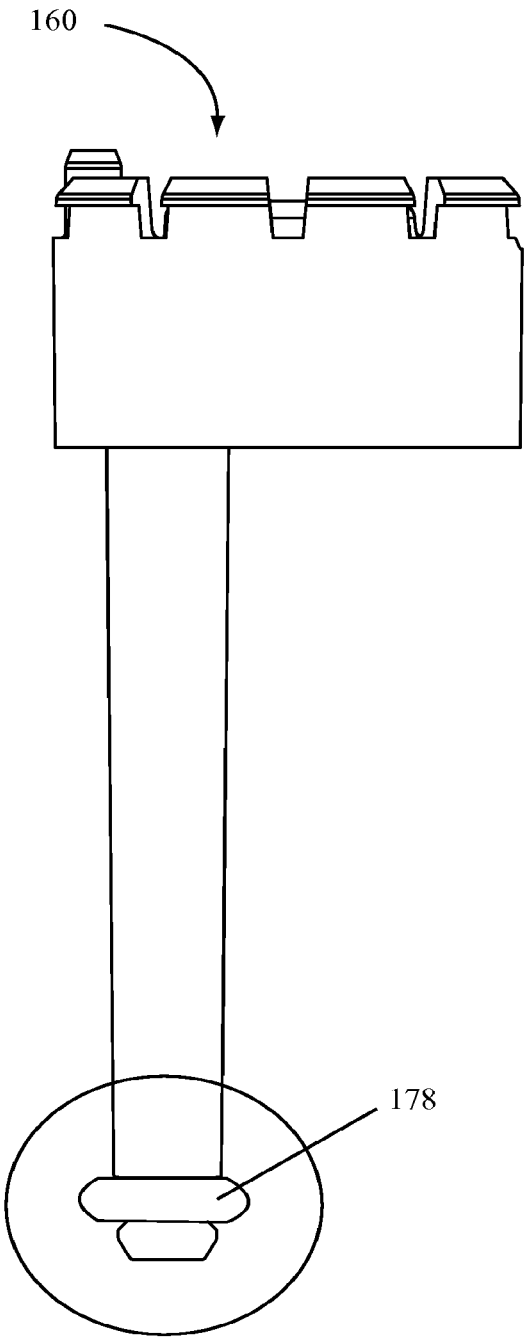
FIG. 16 illustrates a side view of a blown-in dip tube connector according to various embodiments of the invention.
Figure 17:
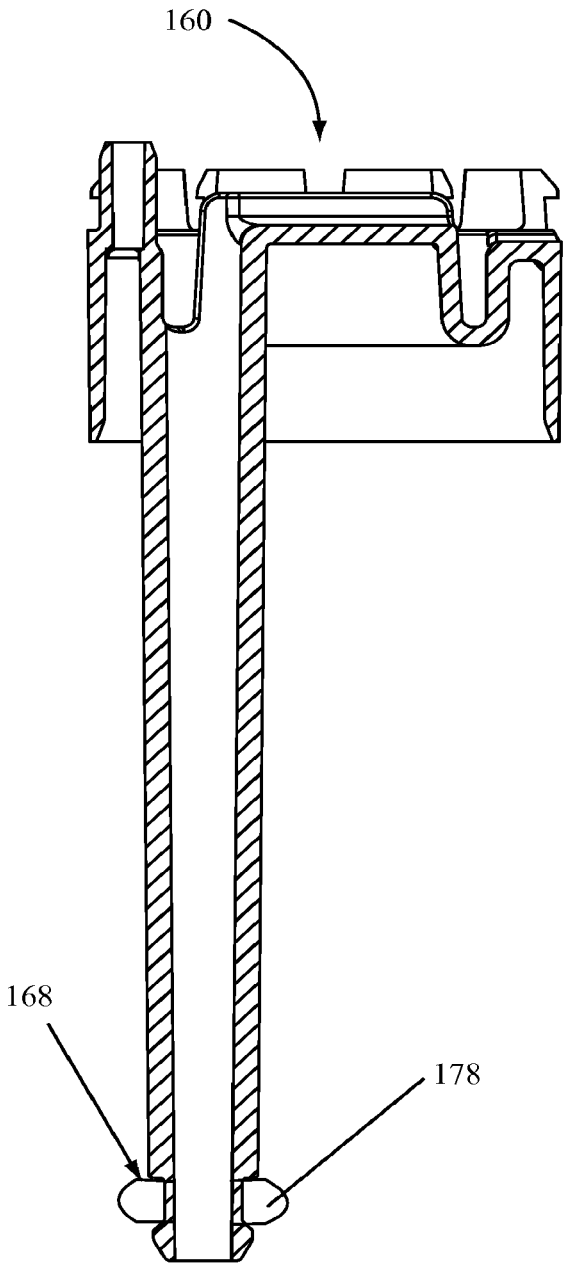
FIG. 17 illustrates a cross-sectional view of a blown-in dip tube connector according to various embodiments of the invention.
Figure 18:
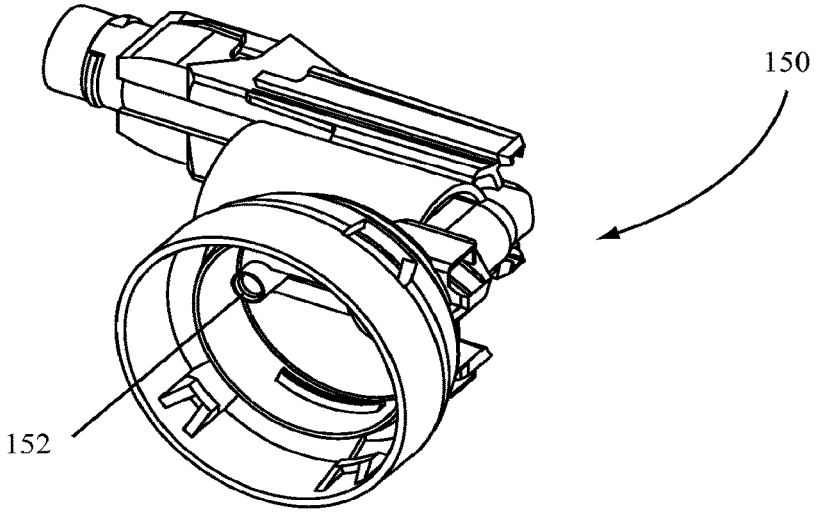
FIG. 18 illustrates a perspective view of a valve body according to various embodiments of the invention.
Figure 19:
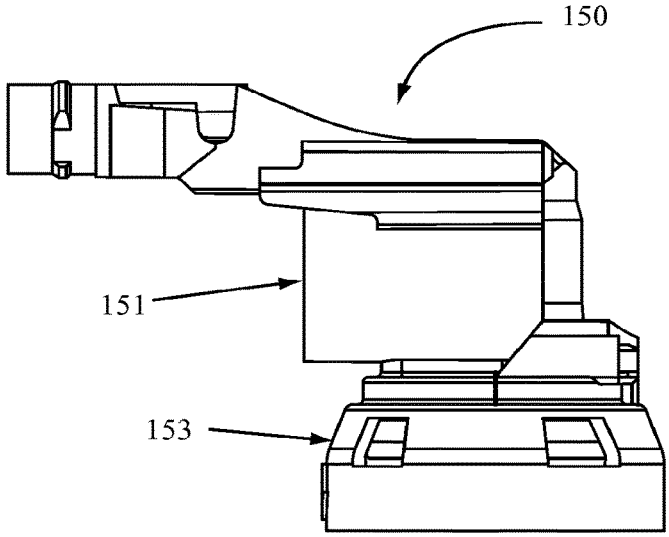
FIG. 19 illustrates a side view of a valve body according to various embodiments of the invention.
Figure 20:
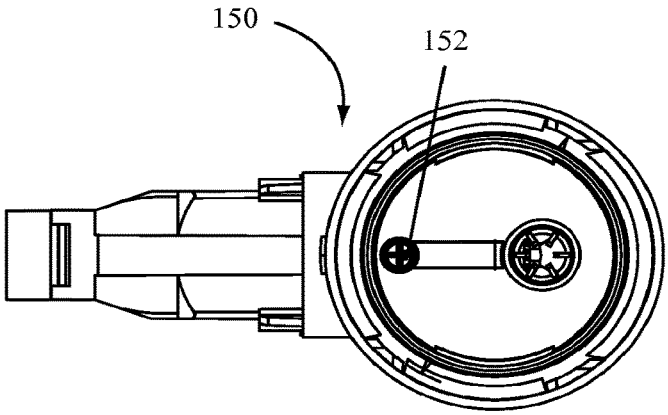
FIG. 20 illustrates a bottom view of a valve body according to various embodiments of the invention.
Figure 21:
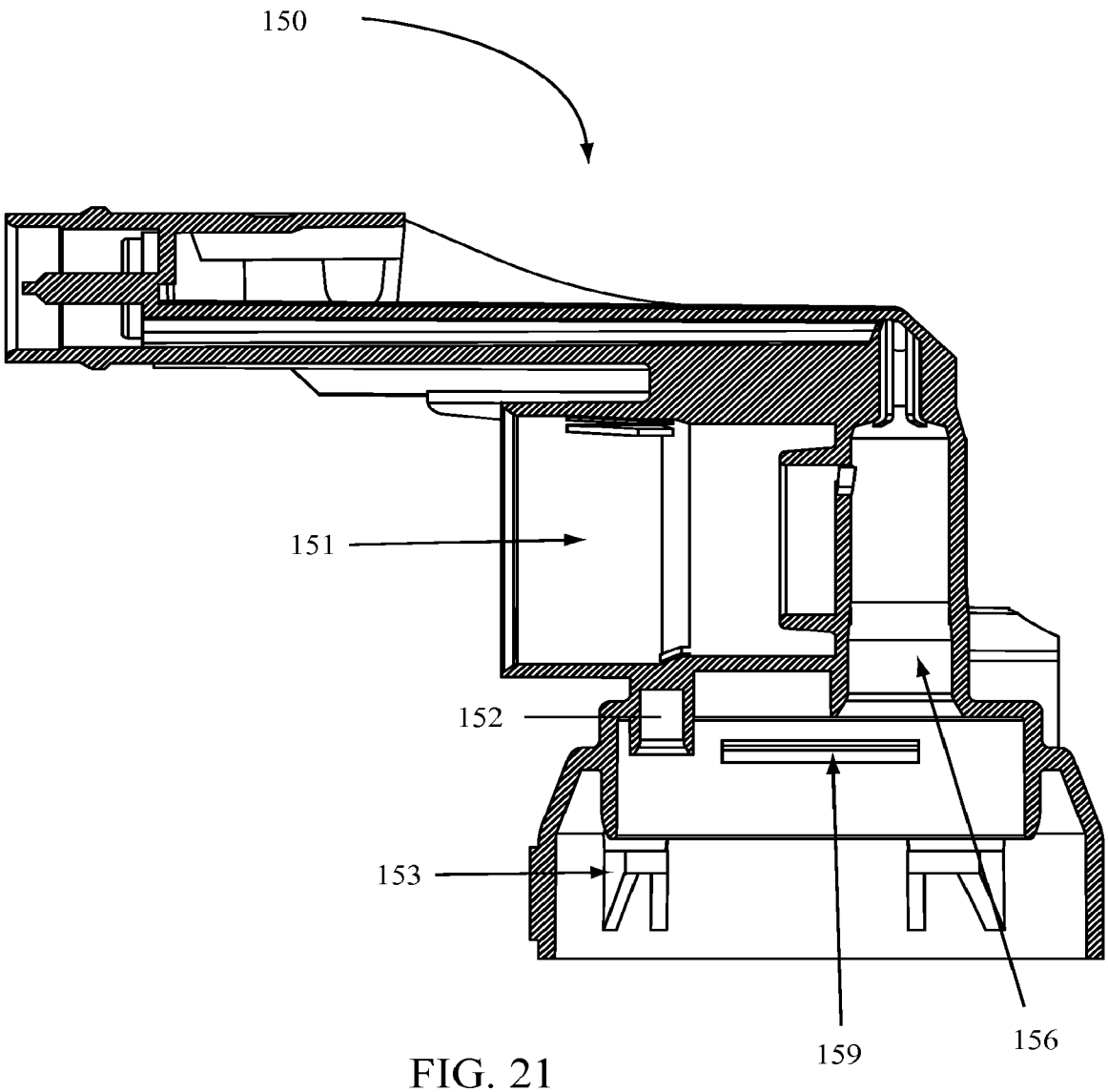
FIG. 21 illustrates a cross-sectional view of a valve body according to various embodiments of the invention.

A blown-in dip tube connector 160 according to still other embodiments of the invention is illustrated in FIGS. 16 and 17. As illustrated, the dip tube lock 168 feature of a blown-in dip tube connector 160 may be fitted with an o-ring 178 or other sealing device to facilitate a seal between the blown-in dip tube connector 160 and a blown-in dip tube. In addition, the ability to add an o-ring 178 or other sealing device to a dip tube lock 168 allows a blown-in dip tube connector 160 as illustrated in FIGS. 9 through 15 to be used with either a blown-in dip tube having a feature to mate with a dip tube lock 168 or a blown-in dip tube where such a feature does not exist.

Figure 25:
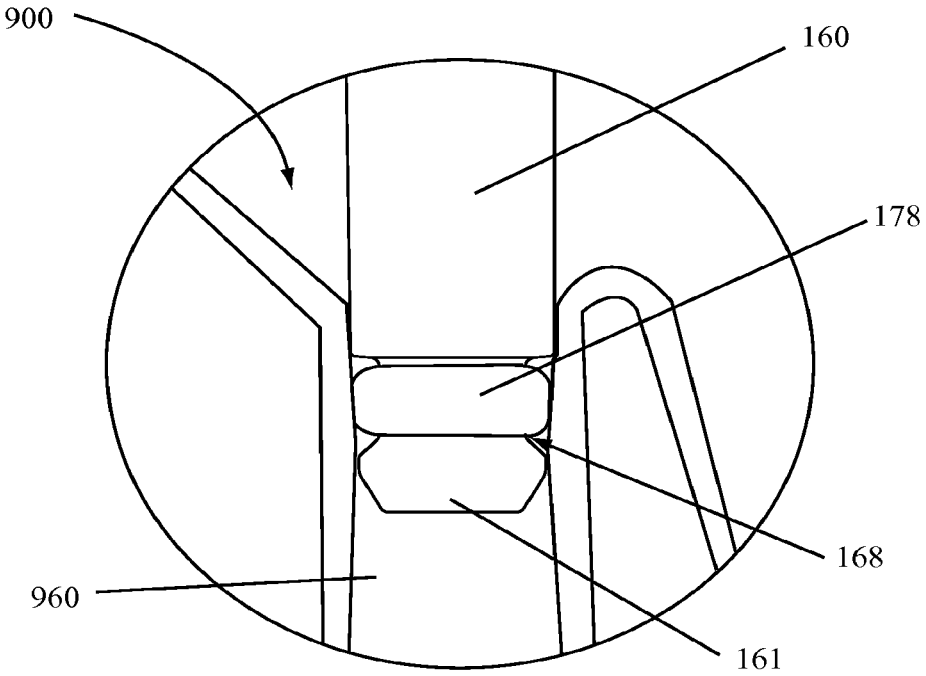
FIG. 25 illustrates a close-up view of a connection between the blown-in dip tube connector illustrated in FIG. 16 and a blown-in dip tube according to various embodiments of the invention.

For example, a detailed view of the blown-in dip tube connector 160 and o-ring 178 circled and illustrated in FIG. 16 is illustrated in FIG. 25. As illustrated, an o-ring 178 may be fitted on a dip tube lock 168 and the fluid inlet 161 end of the blown-in dip tube connector 160 may be inserted into a blown-in dip tube 960 of a bottle 900. At least a portion of the o-ring 178 may mate with the walls of the blown-in dip tube 960 and provide a seal therewith to improve the function of the connection between the blown-in dip tube connector 160 and the blown-in dip tube 960. In other embodiments of the invention, a blown-in dip tube 960 may also include additional features which may mate with an o-ring 178 or provide additional connectivity or retention between the o-ring 178 and the blown-in dip tube 960.

Figure 22A:
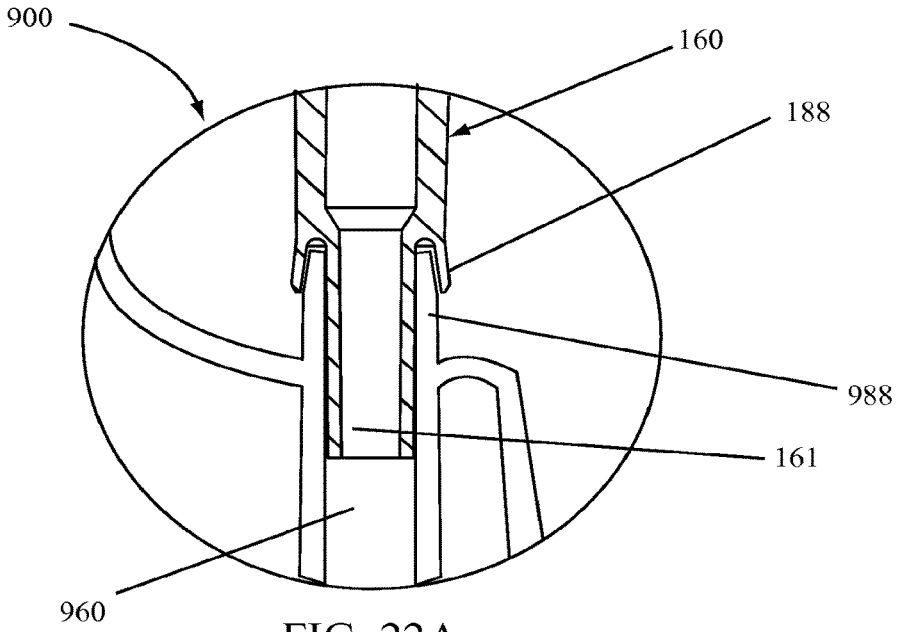
FIGS. 22A and 22B illustrate close-up views of a connection between the blown-in dip tube connector illustrated in FIG. 2 and a blown-in dip tube according to various embodiments of the invention.
Figure 22B:
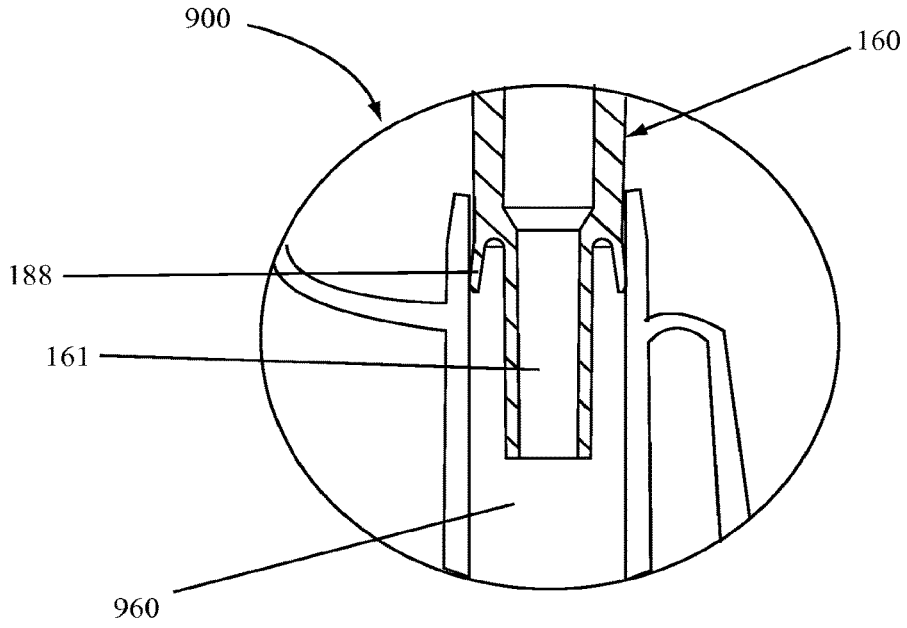

According to still other embodiments of the invention, a blown-in dip tube connector 160 may include a dip tube lip 188 configured to mate with a blown-in dip tube as illustrated in FIGS. 2. 22A and 22B. The circled portion of FIG. 2 is illustrated in FIG. 22A. As illustrated, a container or bottle 900 may include a blown-in dip tube 960. The blown-in dip tube 960 may include a blown-in dip tube lip 988 extending from the bottle 900. When a blown-in dip tube connector 160 is assembled or fitted to the bottle 900, a fluid inlet 161 portion of the blown-in dip tube connector 160 may extend into a portion of a blown-in dip tube 960 and the dip tube lip 188 may rest on, mate with, or seal to the blown-in dip tube lip 988. In such an embodiment, a seal may be formed between the fluid inlet 161 and the blown-in dip tube 960, between the dip tube lip 188 and the blown-in dip tube lip 988, or both the fluid inlet 161 and blown-in dip tube 960 and the dip tube lip 188 and the blown-in dip tube lip 988. In other embodiments of the invention, a dip tube lip 188 may fit on an interior of a blown-in dip tube 960 as illustrated in FIG. 22B. The dip tube lip 188 may seal against a wall of the blown-in dip tube 960 to form a seal between the blown-in dip tube connector 160 and the blown-in dip tube 960.

A pump system 200 according to other embodiments of the invention is illustrated in FIGS. 27 through 30. As illustrated, the pump system 200 may include a blown-in dip tube connector 260 connected to a valve body 250 and retaining a valve 230, such as a ball valve, in the valve body 250. The blown-in dip tube connector 260 may be a one-piece component acting as a valve retainer and as a fluid connection between a blown-in dip tube 960 of a bottle 900 and a trigger sprayer.

Figure 27:
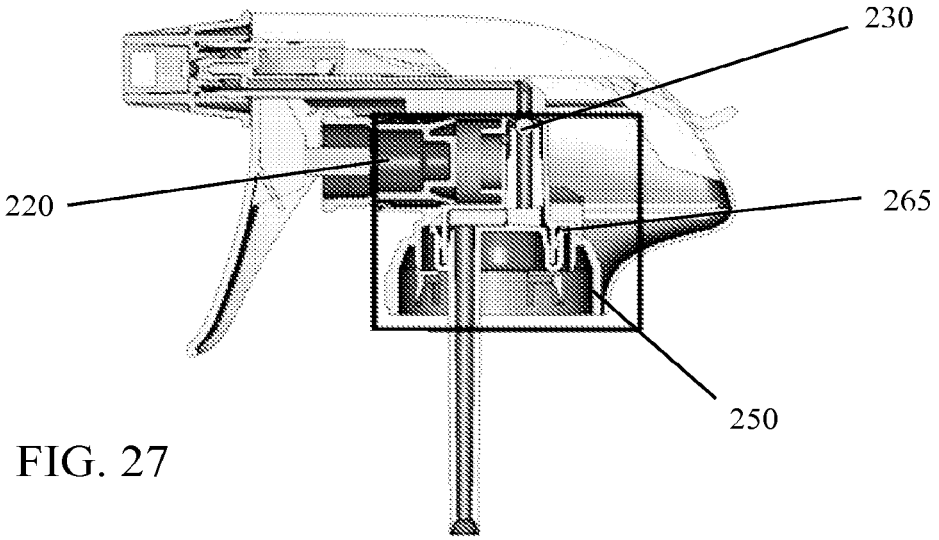
FIG. 27 illustrates a cross-sectional view of a trigger sprayer pump system according to various embodiments of the invention.

A pump system 200 according to certain embodiments of the invention is illustrated in FIG. 27. As illustrated, a blown-in dip tube connector 260 may be attached to a valve body 250 and may retain a valve 230 in the valve body 250. As illustrated, the valve 230 may include a ball which may seat against a portion of the blown-in dip tube connector 260 to form a ball valve. In other embodiments, the valve 230 may include a flap valve, spring valve, or other valve as conventionally known. The blown-in dip tube connector 260 may include one or more connector lips 265, connector tabs, or other connection features to facilitate retention of the blown-in dip tube connector 260 with the valve body 250. For example, the one or more connector lips 265 may snap over one or more connectors 159 integrated with a valve body 250. In some embodiments, the one or more connector lips 265 may be configured to seal with a portion of the valve body 250.

Figure 28:
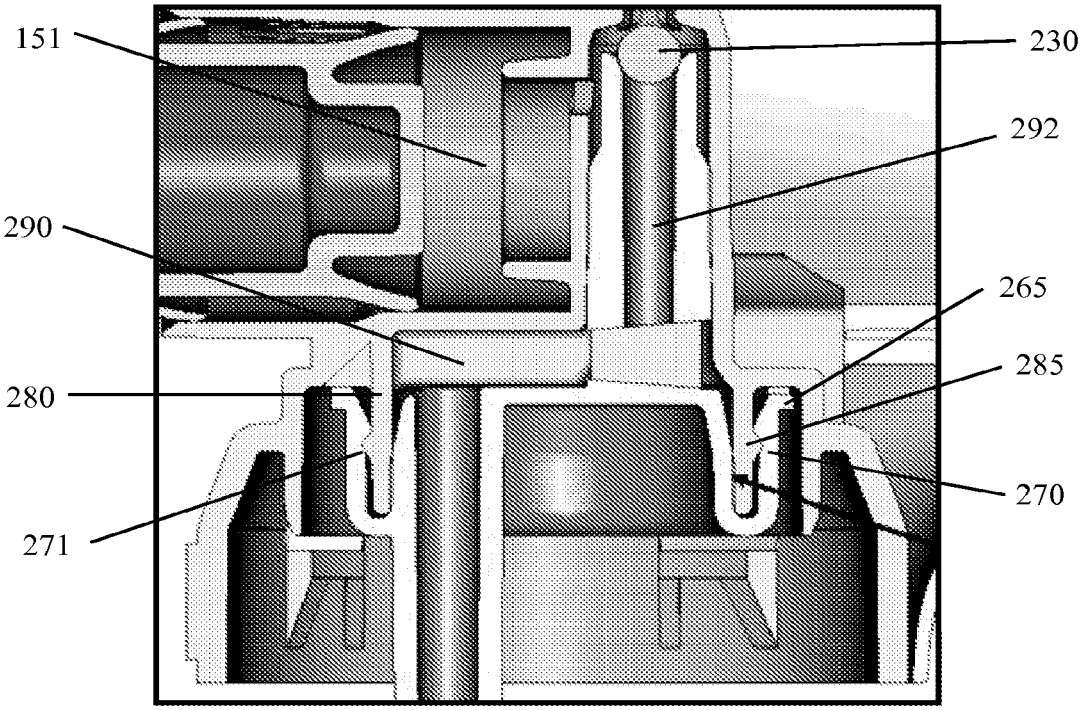
FIG. 28 illustrates a blown-up view of a portion of the trigger sprayer pump system illustrated in FIG. 27.

A blown-up view of the connection formed between a valve body 250 and a blown-in dip tube connector 260 according to certain embodiments of the invention is illustrated in FIG. 28. As illustrated, a valve body 250 may include one or more connection arms 280 or a circumferential connection projection extending in a generally downward direction from the valve body 250 as illustrated. The one or more connection arms 280 may include one or more seal rings 285 projecting therefrom. The one or more seal rings 285 may mate with or seal with one or more plug seal rings 270 in the blown-in dip tube connector 260. A blown-in dip tube connector 260 may also include one or more projections 271 which may mate with a seal ring in the valve body 250 or a portion of the one or more connection arms 280. The fitment of the one or more connection arms 280 with the blown-in dip tube connector 260 may form a fluid tight seal between the blown-in dip tube connector 260 and the valve body 250 such that a fluid chamber 290 is formed between the two parts. Fluid entering the fluid chamber 290 may pass through an upper fluid path 292 of the blown-in dip tube connector 260, past the valve 230 and into a piston chamber 251 of the valve body 250.

Figure 29:
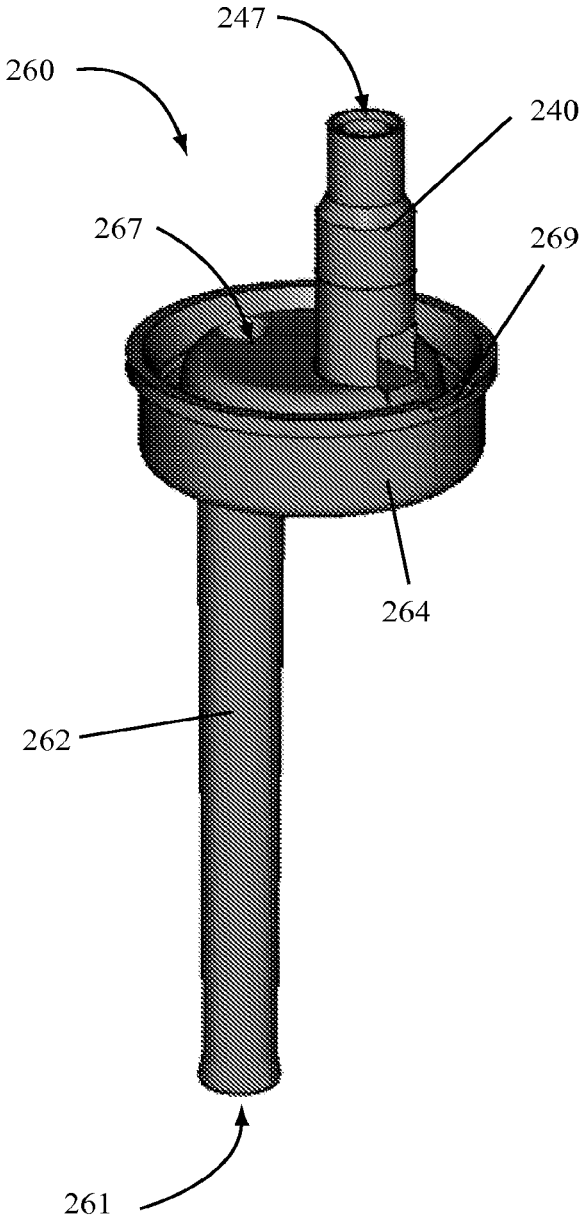
FIG. 29 illustrates a perspective view of a blown-in dip tube connector according to various embodiments of the invention.
Figure 30:
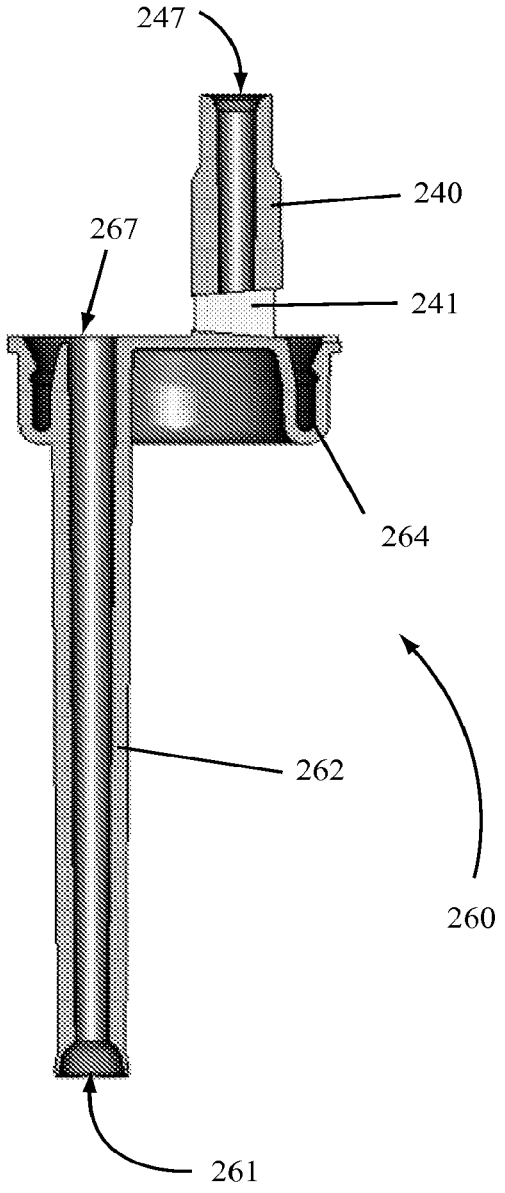
FIG. 30 illustrates a cross-sectional view of a blown-in dip tube connector according to various embodiments of the invention.

A blown-in dip tube connector 260 according to certain embodiments of the invention is illustrated in FIGS. 29 and 30. As illustrated, a blown-in dip tube connector 260 may include a connector head 264 having a port 262 and a valve retainer 240 extending therefrom. The port 262 may extend away from the connector head 264 in one direction and the valve retainer 240 may extend away from the connector head 264 in an opposite direction.

A port 262 according to various embodiments of the invention may include an inlet 261 at the end opposite the connector head 264 and an outlet 267 in the connector head 264. A fluid flow path may be defined between the inlet 261 and outlet 267. According to some embodiments of the invention, the port 262 may include one or more sealing devices located near the inlet 261. For example, the port 262 may include any of a seal ring 163, a dip tube lock 168, an o-ring 178, a dip tube lip 188, flange or other sealing feature described with respect to other embodiments of the invention. In use, a portion of the port 262 near the inlet 261 may seal against or with a blown-in dip tube 960 of a bottle 900.

A valve retainer 240 portion of a blown-in dip tube connector 260 according to embodiments of the invention may include a fluid inlet 241 and a fluid outlet 247. As illustrated, a fluid inlet 241 may include a path through the valve retainer 240 portion of the blown-in dip tube connector 260. In other embodiments, a path extending through the valve retainer 240 portion may be sealed, leaving only a fluid inlet 241 opening. A fluid outlet 247 according to various embodiments of the invention may include a valve seat.

According to various embodiments of the invention, a blown-in dip tube connector 260 may be assembled with a valve body 250 and other components to form a trigger sprayer or pump system 200 which may be assembled with a bottle 900 having a blown-in dip tube 960. When assembled, a portion of a port 262 of the blown-in dip tube connector 260 may seal or mate with the blown-in dip tube 960, forming a fluid tight seal. When operated, fluid may pass through the blown-in dip tube 960, into the blown-in dip tube connector 260 and into the fluid chamber 290 between the blown-in dip tube connector 260 and valve body 250. Further operation of the trigger sprayer may draw fluid from the fluid chamber 290 past the valve 230 and into the piston chamber 251 of the valve body 250 where conventional means are then used to spray such fluid. Thus, a blown-in dip tube connector 260 according to embodiments of the invention may serve as a fluid conduit or fluid flow path between a blown-in dip tube 960 of a bottle 900 and a trigger sprayer or other dispenser.

According to certain embodiments of the invention, a blown-in dip tube connector according to any of the embodiments of the invention may be made of any desirable material. For example, a blown-in dip tube connector may be made of a plastic material. In some embodiments, a blown-in dip tube connector may be made of a polyethylene material. For example, in some embodiments, a blown-in dip tube connector may be made of High-density polyethylene (HDPE). In other embodiments, a blown-in dip tube connector may be made of Medium-density polyethylene (MDPE). In still other embodiments, a blown-in dip tube connector may be made of a material that allows the blown-in dip tube connector to flex such that if a bayonet-type connection between a pump system 100 and bottle 900 is used, removal of the pump system 100 may be facilitated by the ability of the blown-in dip tube connector to flex during removal of the pump system 100 from the bottle 900. For example, as a bayonet connection is removed from a bottle 900, the valve body 150 is typically twisted off of the bottle 900. As the valve body 150 is twisted, a fluid flow path 162 portion of a blown-in dip tube connector 160 may flex allowing the valve body 150 to twist to release the bayonet connection while maintaining a seal or connection between the blown-in dip tube connector 160 and a blown-in dip tube 960.

While various embodiments of the invention are illustrated with a blown-in dip tube connector 160 mated with a valve body 150, a blown-in dip tube connector 160 may also be fitted with or retained by connection with a ball retainer 140. For example, connectors on a ball retainer 140 may mate with or fit with the connectors on the blown-in dip tube connector 160 such that the blown-in dip tube connector 160 and ball retainer 140 snap together. Assembly of the ball retainer 140 and blown-in dip tube connector 160 with a valve body 150 may be made by snap fitment of the ball retainer 140 with the valve body 150, snap fitment of the blown-in dip tube connector 160 with the valve body 150, both snap fitment of the ball retainer 140 and blown-in dip tube connector 160 with the valve body 150 or through other conventional fitment or retention systems.

Figure 31:
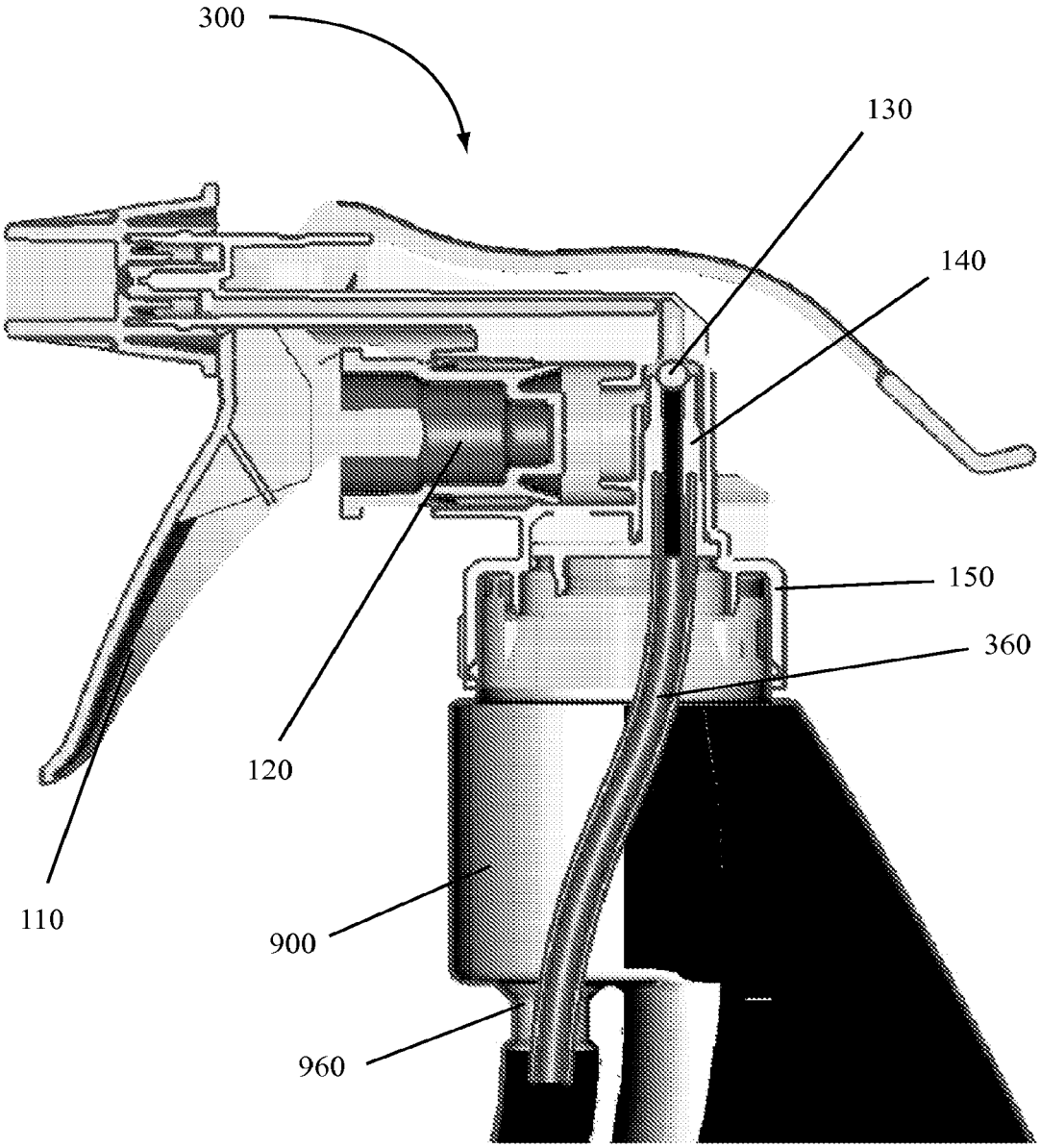
FIG. 31 illustrates a cross-sectional view of a trigger sprayer pump system according to various embodiments of the invention.

A pump system 300 according to still other embodiments of the invention is illustrated in FIG. 31. As illustrated, a pump system 300 may include a trigger sprayer having a valve body 150, a piston 120, an integrated trigger and spring 110, a ball valve 130, and a ball retainer 140 as with other embodiments of the invention. The pump system 300 may also include a flexible tube 360 which may act as a connector between a blown-in dip tube 960 of a bottle 900 and other components of the pump system 300. The pump system 300 may also include any of a shroud 190 and nozzle 192 as conventionally known. In addition, the integrated trigger and spring 110 combination may be substituted with a conventional plastic or metal spring and trigger.

According to certain embodiments of the invention, the use of a flexible tube 360 to create a fluid flow path between a blown-in dip tube 960 and a trigger sprayer is a solution which can be easily adapted to existing trigger sprayers having fluid flow paths that are not in-line with a blown-in dip tube 960 opening of a bottle. For example, as illustrated in FIG. 31, one end of a flexible tube 360 may be inserted in, fitted in, or otherwise in communication with, a valve body 150, ball retainer 140, tube retainer, or other fluid flow path in the pump system 300. An opposite end of the flexible tube 360 may be inserted into an opening in the blown-in dip tube 960 of the bottle 900. An opening in the blown-in dip tube 960 may include funnel shaped walls to help guide an end of a flexible tube 360 into sealing engagement with the blown-in dip tube 960. The end of the flexible tube 360 inserted into the blown-in dip tube may seal against the interior walls of the blown-in dip tube 960 such that a fluid tight seal is formed allowing the pump system 300 to retain prime once primed by a user. According to some embodiments of the invention, the end of the flexible tube 360 inserted into the opening of the blown-in dip tube 960 may include a sealing device as well. For example, the end of the flexible tube 360 inserted into the opening of the blown-in dip tube 960 may include any of a seal ring 163, a dip tube lock 168, an o-ring 178, a dip tube lip 188, flange or other sealing device according to embodiments of the invention.

When assembled, a pump system 300 utilizing a flexible tube 360 according to embodiments of the invention provides a bent or curved fluid path from a blown-in dip tube 960 in a bottle 900 to a trigger sprayer. In some embodiments, the flexible tube 360 may provide a fluid path or supply line directly connecting a blown-in dip tube 960 in a bottle 900 to a trigger sprayer fluid supply line or fluid flow path.

Unlike the trigger supply lines illustrated in United States Patent Application 2010/0096415 which include "direct alignment" with an integral dip tube or blown-in dip tube of a bottle, the flexible tube 360 according to embodiments of the invention creates an indirect supply route from the blown-in dip tube 960 to a trigger actuator. In addition, the use of a flexible tube 360 according to embodiments of the invention allows conventional trigger sprayers having fluid supply tubes which are offset from a front portion of a bottle, or offset from the location that a blown-in dip tube 960 of a bottle 900 would be located, to be fitted with a flexible tube 360 and connected to a bottle 900 having a blown-in dip tube 960 as illustrated in FIG. 31. Thus, direct alignment of a trigger supply line with a blown-in dip tube 960 opening in unnecessary. This is also advantageous because, unlike the forward sitting trigger sprayers of United States Patent Application 2010/0096415, a trigger sprayer, and its mass, may be located more towards the middle of the bottle or toward the side of the bottle 900 opposite the blown-in dip tube 960 when combined with a flexible tube 360 according to embodiments of the invention. This may improve the balance and ergonomics of such an embodiment over the straight direct alignment of other trigger supply lines. The use of a flexible tube 360 to connect a trigger sprayer or pump system 300 with a blown-in dip tube 960 may also allow the use of a trigger sprayer having a centrally located, or an offset, fluid supply path into the trigger sprayer.

The use of a flexible tube 360 according to embodiments of the invention may also be advantageous in that shortened dip tubes may be used as a flexible tube 360. Alternatively, a trigger sprayer or pump system fitted with a conventionally sized dip tube may have that dip tube cut such that the end of the shortened dip tube may be inserted into a blown-in dip tube 960 of a bottle 900 on the filling line. This may allow conventional trigger sprayers fitted with dip tubes to be used with bottles 900 having blown-in dip tubes 960.

According to embodiments of the invention, a flexible tube 360 may be assembled to a bottle 900 on a filling line. In some embodiments of the invention, a bottle 900 having a blown-in dip tube 960 may be filled, or partially filled, with a fluid product as conventionally known. A pump system 300 fitted with a flexible tube 360 may be aligned such that the flexible tube 360 may mate with an opening in the blown-in dip tube 960 as the pump system 300 is assembled to the bottle 900 on the filling line. After reaching sufficient insertion depth, the pump system 300 may be moved and aligned with the bottle 900 opening such that the pump system 300 may be attached to the bottle 900, for example, using a conventional bayonet fitment system or twist on closure system. The resulting configuration is illustrated in FIG. 31 wherein the flexible tube 360 includes sufficient curvature to connect the fluid supply line of the trigger sprayer with the blown-in dip tube 960.

Figure 32:
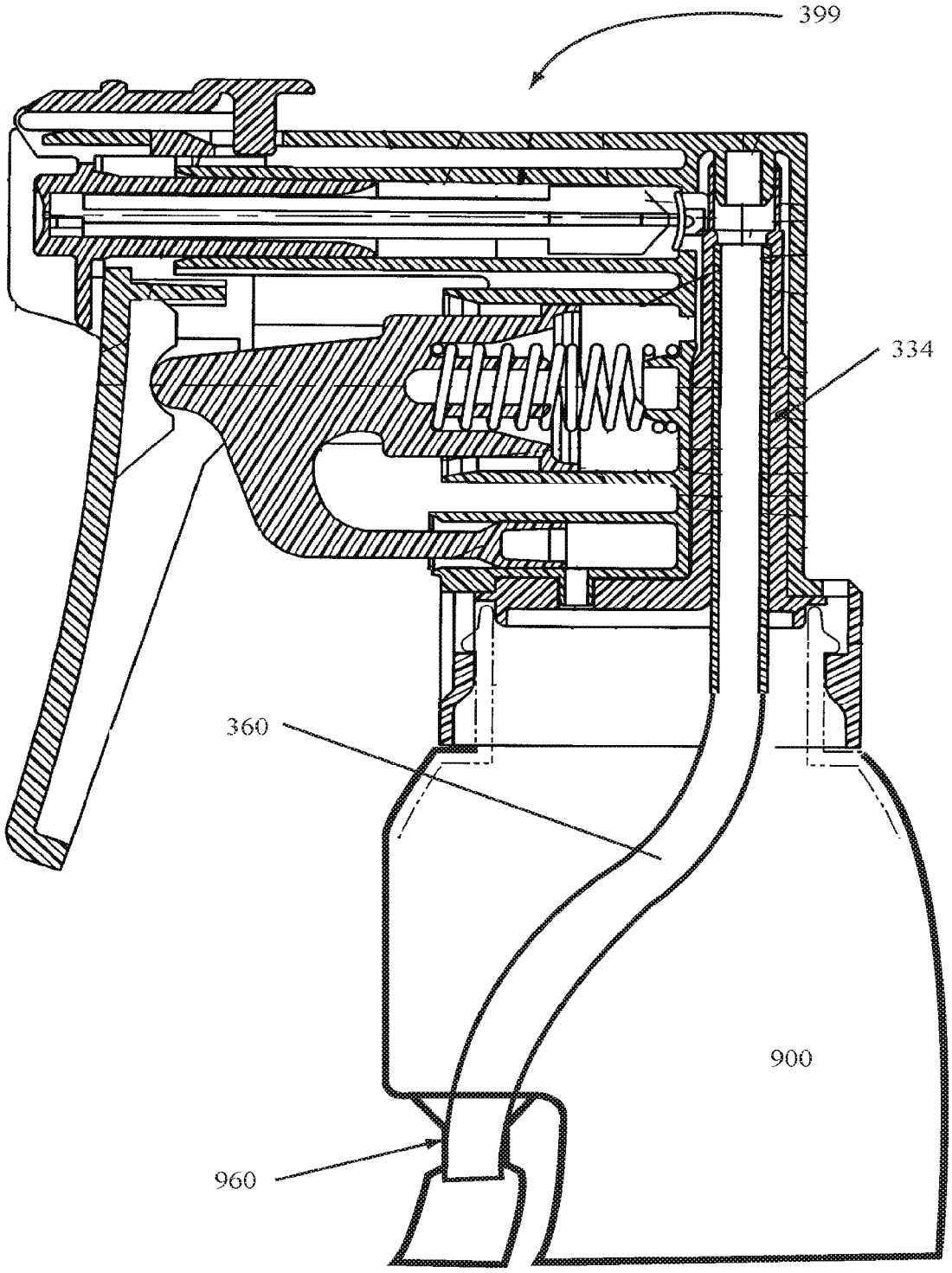
FIG. 32 illustrates a cross-sectional view of a trigger sprayer pump system according to various embodiments of the invention.

According to some embodiments of the invention, the ball valve 130 and ball retainer 140 may be substituted with a tube retainer and ball valve 130 or other conventional valve system. For example, FIG. 32 illustrates a conventional trigger sprayer 399 or dispensing mechanism fitted with a flexible tube 360 according to embodiments of the invention. The trigger sprayer 399 or dispensing mechanism is further described and illustrated in U.S. Pat. No. 5,906,301, which is incorporated herein by reference in its entirety. As illustrated in FIG. 32, a portion of the flexible tube 360 according to embodiments of the invention may be fitted in a seal assembly 334 or tube retainer of the trigger sprayer 399. The fitment of the flexible tube 360 with the seal assembly 334 or tube retainer may be sufficient or snug enough such that the flexible tube 360 is not easily removed, or cannot be removed, from the trigger sprayer 399 once assembled.

A flexible tube 360 according to embodiments of the invention may be made of a flexible material. For example, in some embodiments of the invention, a flexible tube 360 may be a flexible plastic material. In some particular embodiments, a low-density polyethylene (LDPE) material may be used to make a flexible tube 360 according to embodiments of the invention.

Figure 33:
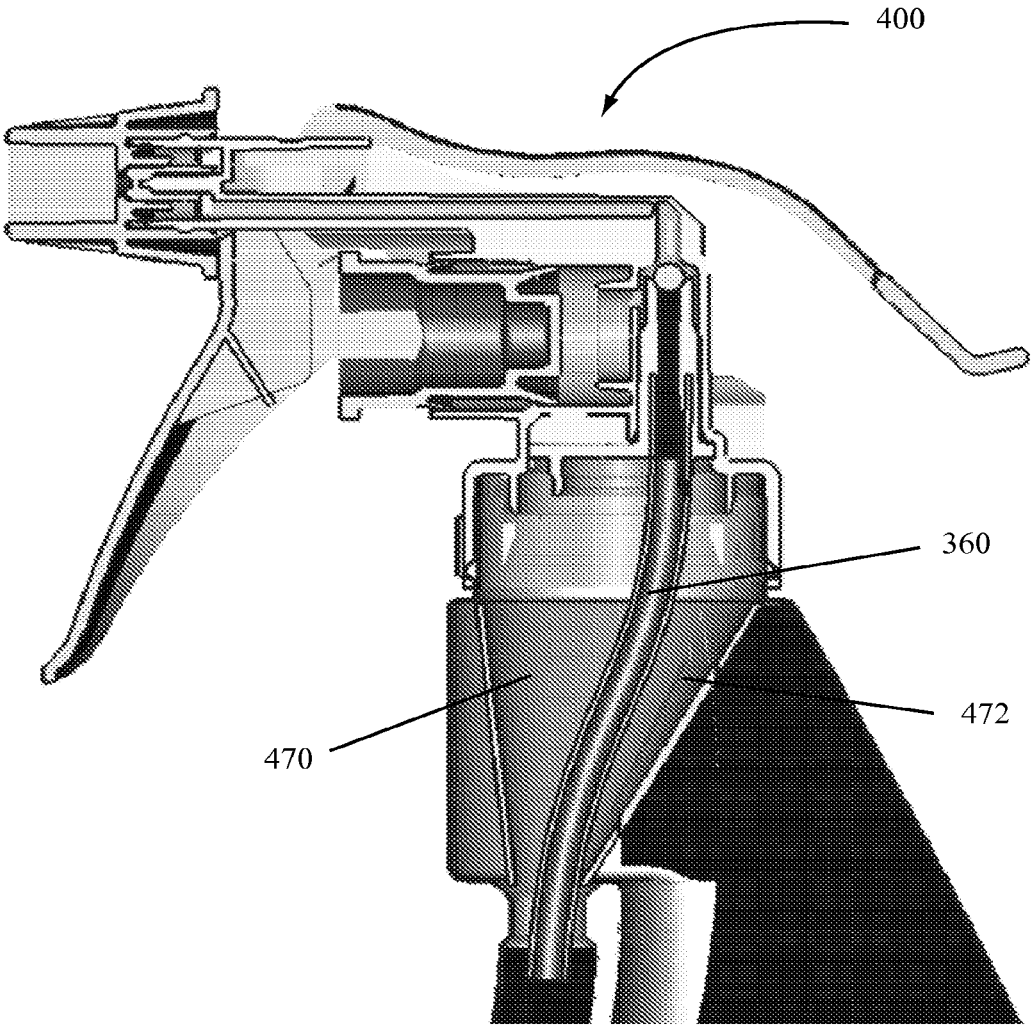
FIG. 33 illustrates a cross-sectional view of a trigger sprayer pump system according to various embodiments of the invention.

According to other various embodiments of the invention, a pump system 400 may include a funnel 470 as illustrated in FIG. 33. A funnel 470 may be inserted into a bottle 900 to help guide a flexible tube 360 into an opening in the blown-in dip tube 960 of the bottle 900. As illustrated, the funnel 470 may be positioned with a wide opening closer the top of the bottle 900 and a narrowing portion to an opening or landing in the blown-in dip tube 960. A funnel 470 according to embodiments of the invention may be made of any desirable material. In some embodiments, a funnel 470 may be made of a plastic material.

According to various embodiments of the invention, a funnel 470 may include one or more openings 472 in the side walls of the funnel 470. The one or more openings 472 in the side walls of the funnel 470 may allow a fluid to pass through the funnel 470 and fill the bottle 900. For example, a bottle 900 fitted with a funnel 470 having one or more openings 472 may be filled by directing fluid into the funnel 470. As fluid enters the funnel 470 it may pass through the one or more openings 472 and into an interior portion of the bottle 900. In some embodiments of the invention, a funnel 470 may be inserted in a bottle 900 prior to filling of the bottle 900 on a fill line and the bottle 900 filled with the funnel 470 in place. According to other embodiments of the invention, a funnel 470 may be added to a bottle 900 following a filling process; thus, a bottle 900 could be filled and a funnel 470 then inserted into the bottle 900 before a pump system 400 or trigger sprayer having a flexible tube 360 is attached to the bottle 900.

According to embodiments of the invention, a funnel 470 may help guide a flexible tube 360 into the opening of a blown-in dip tube 960. As only a portion of the funnel 470 in needed to guide a flexible tube 360, the one or more openings 472 in a funnel 470 may be quite large to allow for filling of a bottle 900 through a funnel 470 or with the funnel 470 fitted in the bottle 900.

A funnel 470 according to certain embodiments of the invention may be secured to the bottle 900 at an opening of the bottle 900, at an opening of the blown-in dip tube 960 or in any other desirable manner.

Figure 34:
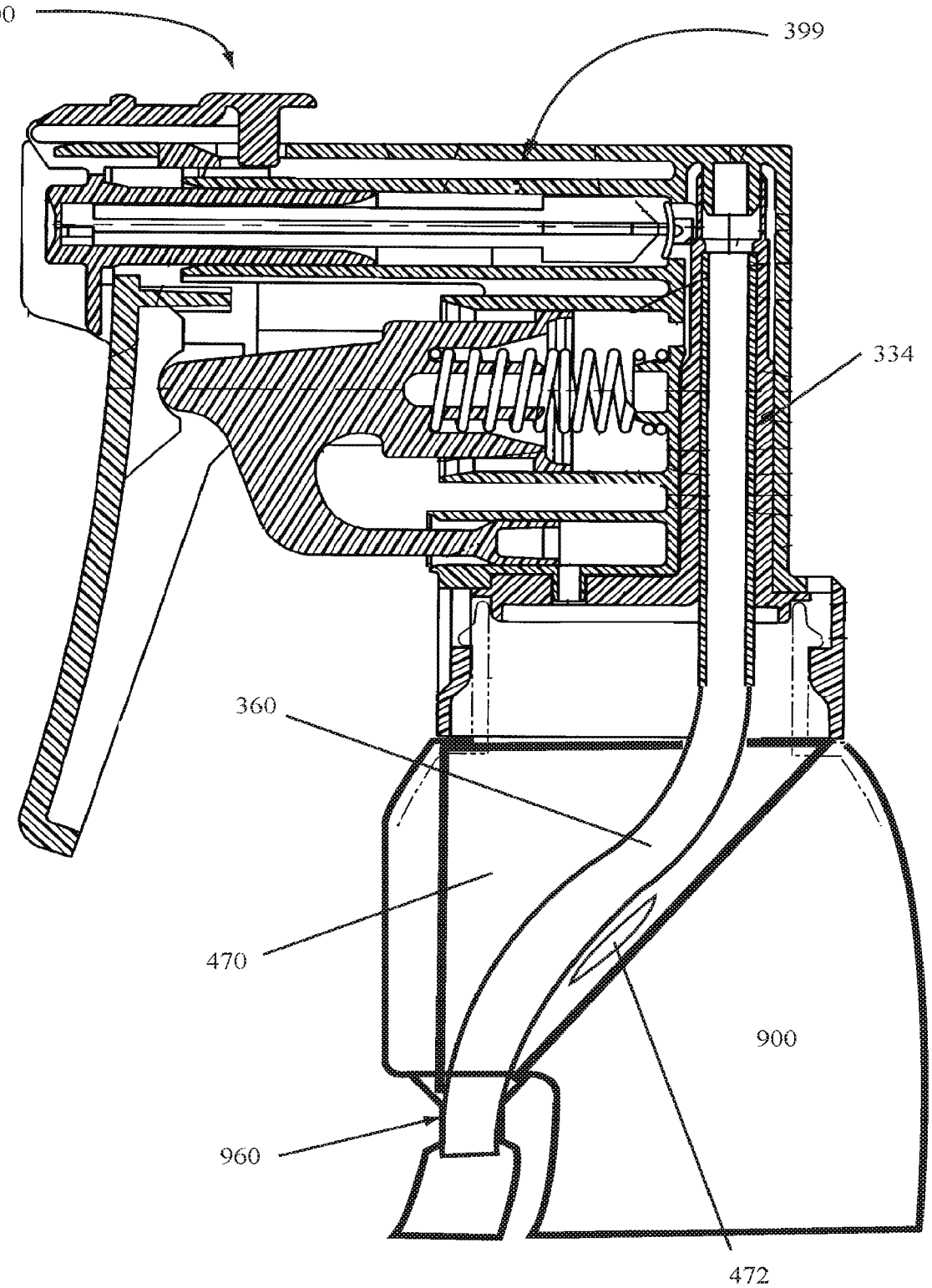
FIG. 34 illustrates a cross-sectional view of a trigger sprayer pump system according to various embodiments of the invention.

An embodiment of a pump system 400 including a funnel 470 is illustrated in FIG. 34. As illustrated, a conventional trigger sprayer 399 such as that illustrated and described in U.S. Pat. No. 5,906,301 may be fitted with a flexible tube 360 according to embodiments of the invention and assembled with a bottle 900 having a blown-in dip tube 960 and a funnel 470 inserted in the bottle 900. The funnel 470 may help guide the flexible tube 360 into the blown-in dup tube 960 during assembly of the pump system 400. In addition, the use of the funnel 470 may allow a trigger sprayer 399 to be assembled directly to the bottle 900 without first aligning the flexible tube 360 with the blown-in dip tube 360 opening.

Figure 35:
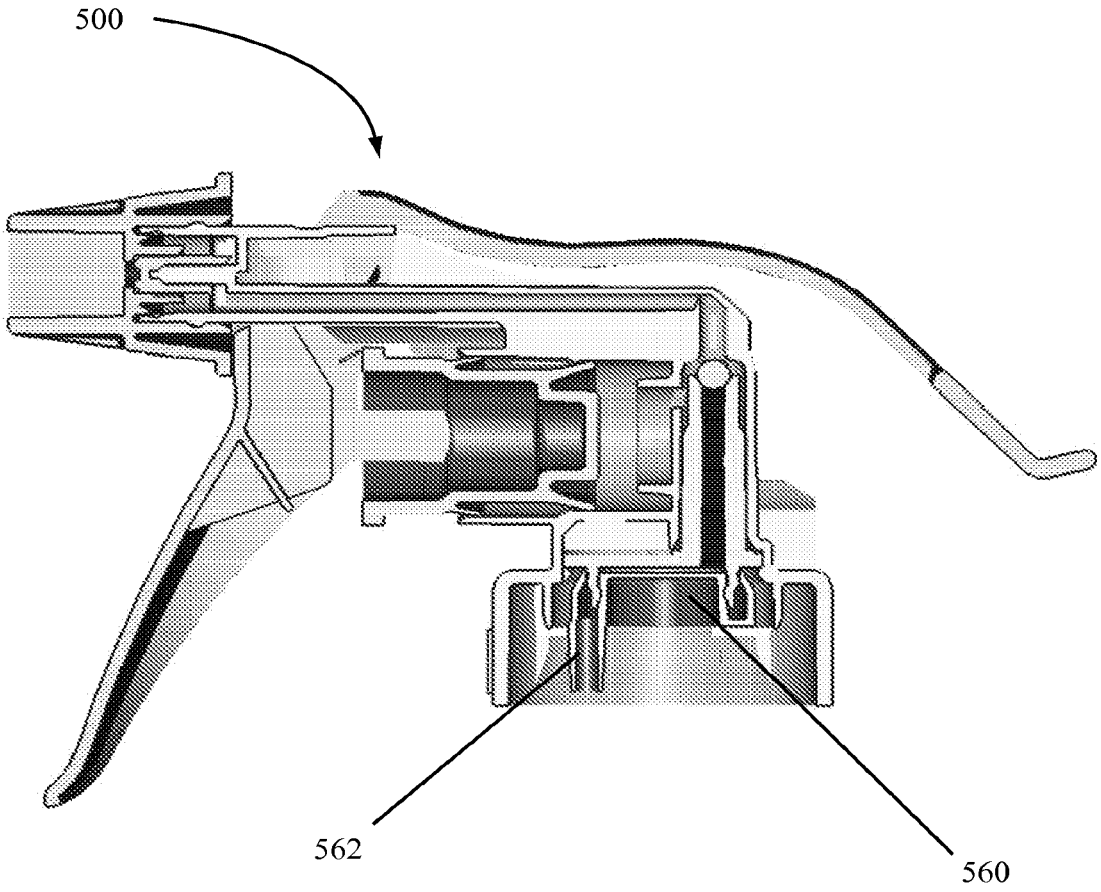
FIG. 35 illustrates a cross-sectional view of a trigger sprayer pump system according to various embodiments of the invention.

According to other embodiments of the invention, a pump system 500 may include a swivel adapter 560, or rotatable connector, which may provide a fluid path between a blown-in dip tube 960 and a trigger sprayer. For example, a swivel adapter 560 according to certain embodiments of the invention is illustrated in FIG. 35. As illustrated, a pump system 500 may include a trigger sprayer having a valve body 150, a piston 120, an integrated trigger and spring 110, a ball valve 130, and a ball retainer 140 similar to other embodiments of the invention. The pump system 500 may also include a swivel adapter 560 snapped onto the ball retainer 140 or valve body 150 and which may act as a connector between a blown-in dip tube 960 of a bottle 900 and other components of the pump system 500. The pump system 500 may also include any of a shroud 190 and nozzle 192 as conventionally known. In addition, the integrated trigger and spring 110 combination may be substituted with a conventional plastic or metal spring and trigger.

According to some embodiments of the invention, a swivel adapter 560 or rotatable connector may be configured to rotate such that a trigger sprayer utilizing the swivel adapter 560 may be assembled to a bottle 900 having a blown-in dip tube 960 and then disassembled by twisting the trigger sprayer off of a bayonet connection with the bottle 900. A port 562 on the swivel adapter 560 may mate with and seal to an opening of a blown-in dip tube 960. When the trigger sprayer to which the swivel adapter 560 is attached is rotated, the swivel adapter may remain in one location with the port 562 sealed to the blown-in dip tube 960 opening while the rest of the trigger sprayer moves. This feature may allow the swivel adapter to maintain alignment with the blown-in dip tube 960 as the pump system 500 is removed from a bottle 900. The trigger sprayer and swivel adapter 560 may then be disconnected from the bottle 900 and the seal between the port 562 and blown-in dip tube 960 broken.

Figure 36:
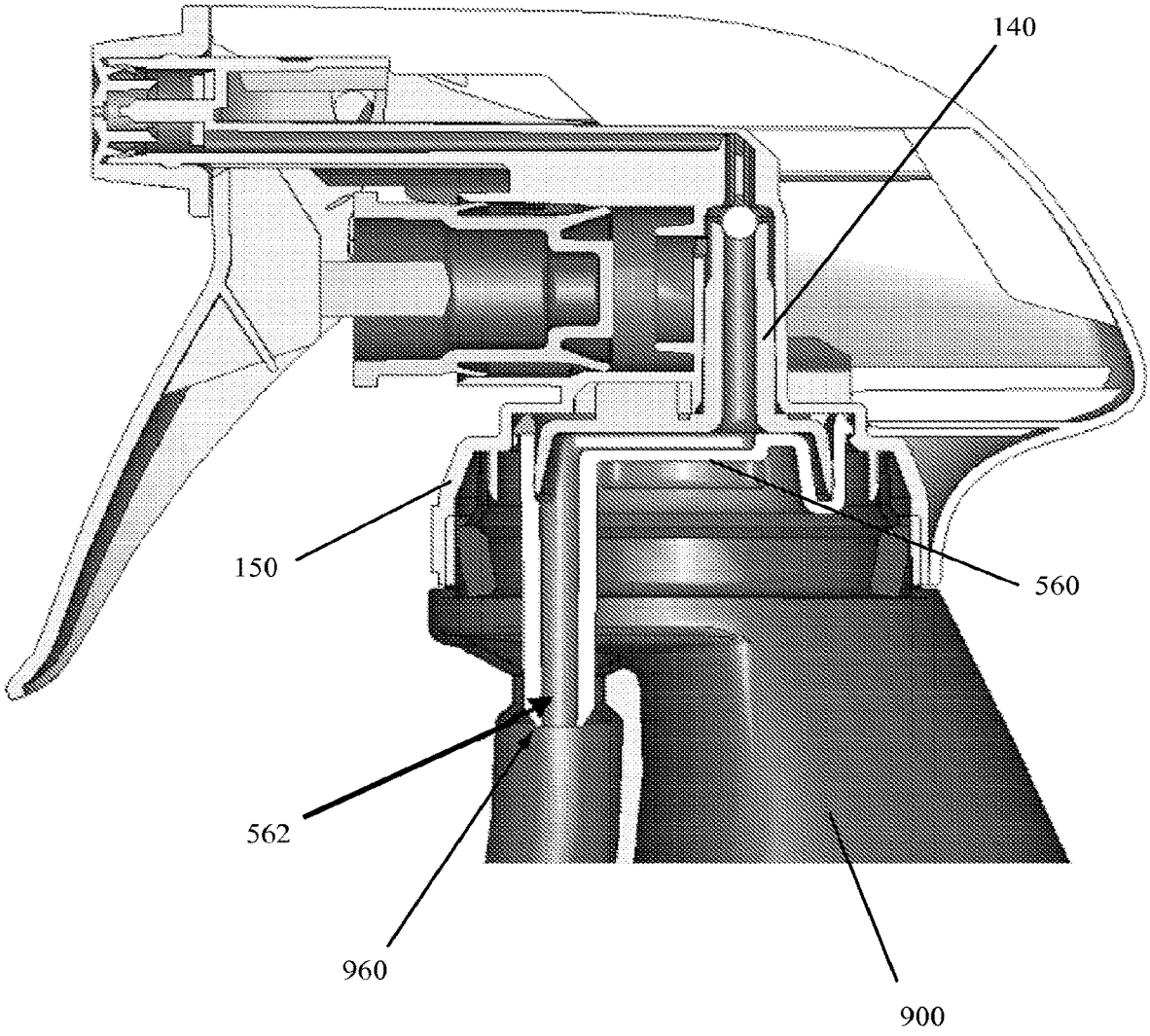
FIG. 36 illustrates a cross-sectional view of a trigger sprayer pump system according to various embodiments of the invention.
Figure 37:
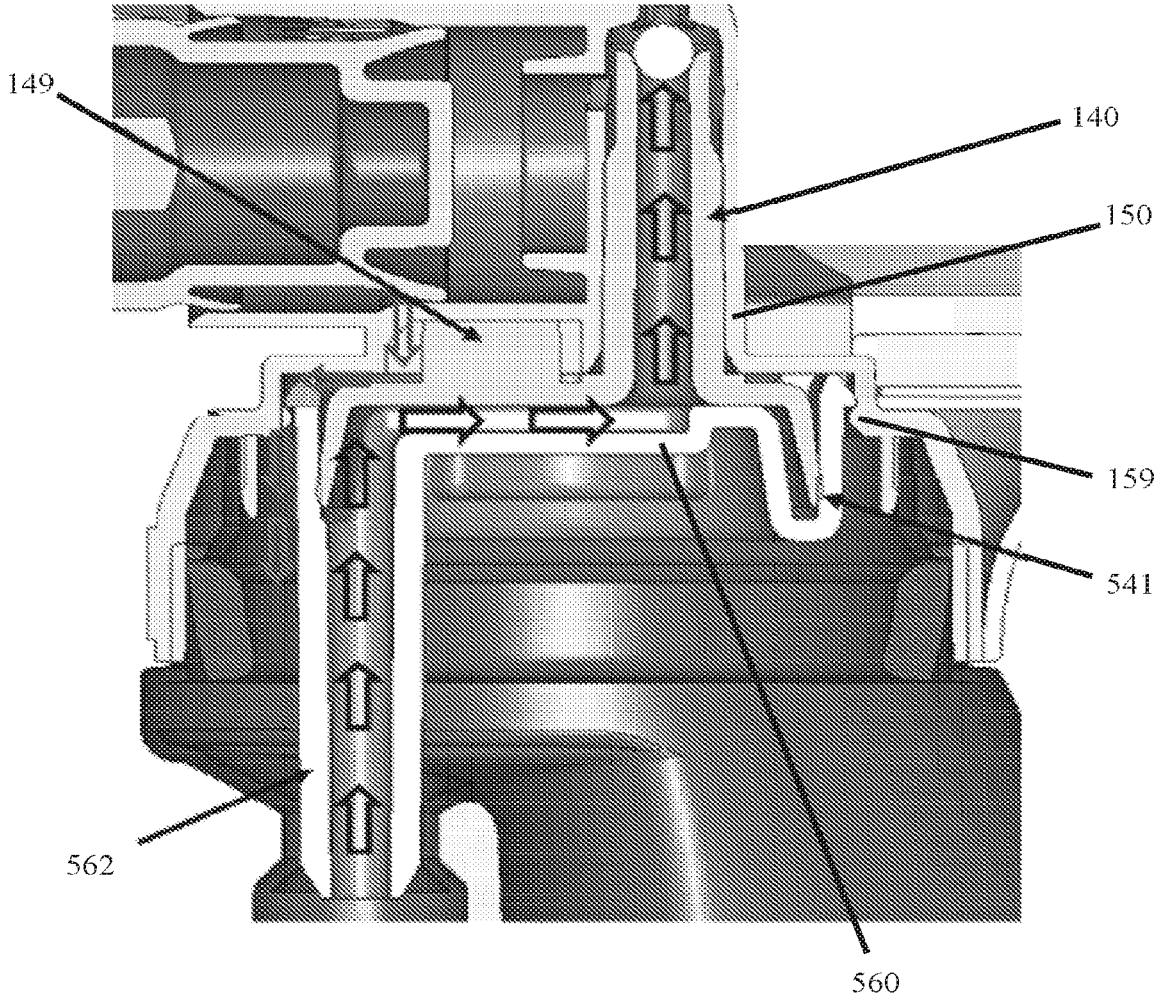
FIG. 37 illustrates a cross-sectional view of a trigger sprayer pump system according to various embodiments of the invention.

A swivel adapter 560 according to various embodiments of the invention is illustrated in FIGS. 36 and 37. A cross-sectional view of a swivel adapter 560 assembled with a trigger sprayer according to embodiments of the invention and attached to a bottle 900 having a blown-in dip tube 960 is illustrated in FIG. 36. As shown, the swivel adapter 560 may be snap fit or otherwise connected to the valve body 150 or to a ball retainer 140. A port 562 associated with the swivel adapter 560 may be sealed in an opening of the blown-in dip tube 960 of the bottle 900. In some embodiments, the port 562 of the swivel adapter 560 may extend beyond the valve body 150 or outside of the valve body 150 as illustrated. In this manner, the port 562 may reach a blown-in dip tube 960 opening positioned below a top opening of the bottle 900. Thus, the swivel adapter 560 provides a fluid path between the blown-in dip tube 960 and the trigger sprayer. In addition, in some embodiments the blown-in dip tube 960 may include a funnel-shaped opening as illustrated in FIG. 36 such that a port 562 of a swivel adapter may be more easily aligned and fit into an opening in a blown-in dip tube 960 for sealing engagement thereof.

A more detailed view of a swivel adapter 560 or rotatable connector according to various embodiments of the invention is illustrated in FIG. 37. As illustrated, a swivel adapter 560 according to certain embodiments of the invention may snap fit onto the valve body 150 of the pump system 500. The valve body 150 may include one or more connectors 159 to which the swivel adapter 560 may connect and the swivel adapter 560 may include one or more latches or snap fitment features to facilitate connection to the valve body 150. A ball retainer 140 may also include one or more features or seals, such as a radial seal 541, allowing the ball retainer 140 to seal with the swivel adapter 560. While the swivel adapter 560 may connect to the valve body 150, the connection may be configured such that the swivel adapter 560 may move relative to the valve body 150. A port 562 associated with the swivel adapter 560 may fit into and seal with an opening in the blown-in dip tube 960 of the bottle 900 as illustrated. In some embodiments of the invention, the port 562 may also include one or more seal features such as a seal ring 163, a dip tube lock 168, an o-ring 178, a dip tube lip 188, flange or other sealing device according to various embodiments of the invention. Such features may facilitate an improved seal with an opening in the blown-in dip tube 960.

Figure 38:
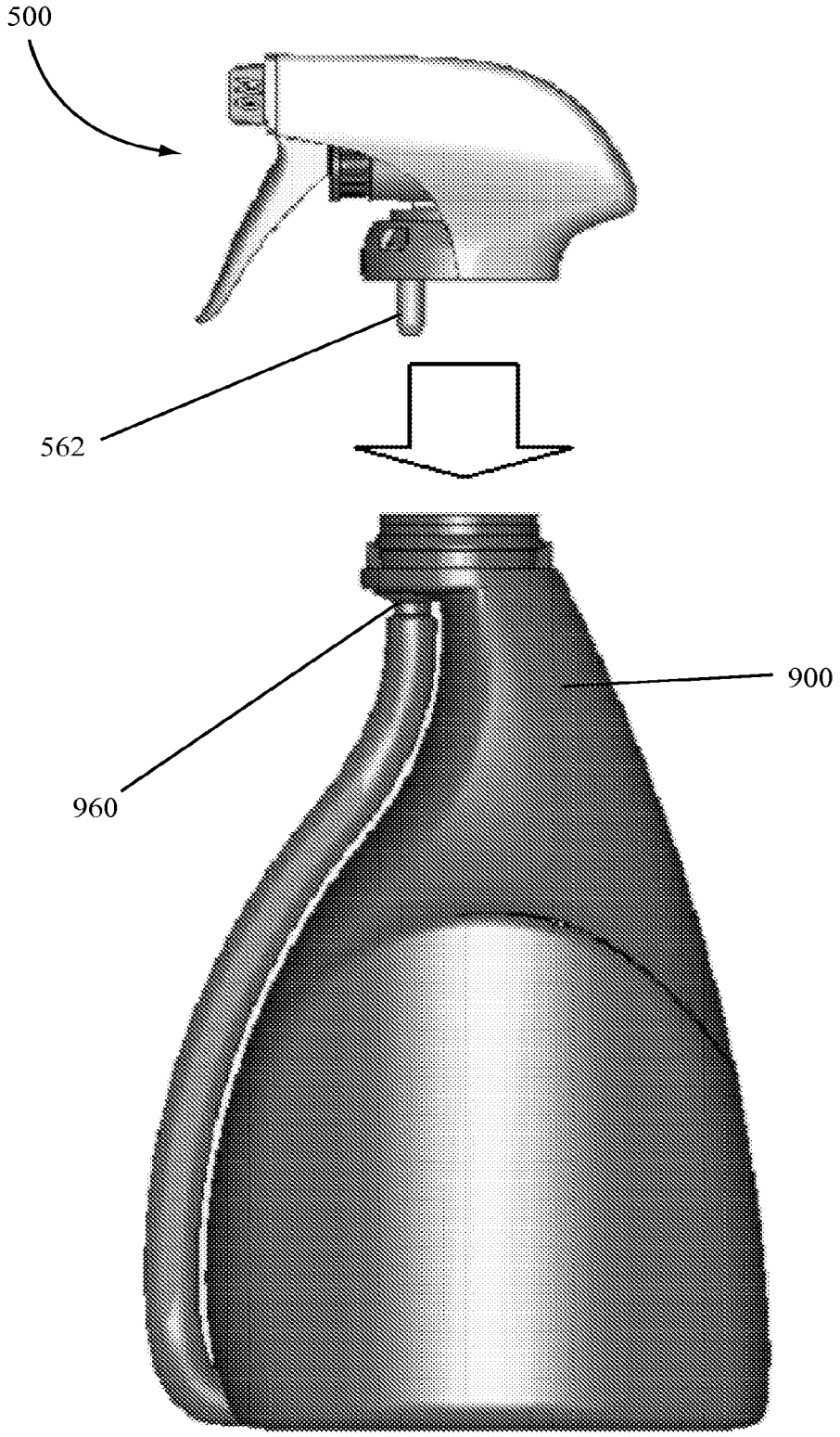
FIG. 38 illustrates a trigger sprayer being assembled to a bottle having a blown-in dip tube according to various embodiments of the invention.
Figure 39A:
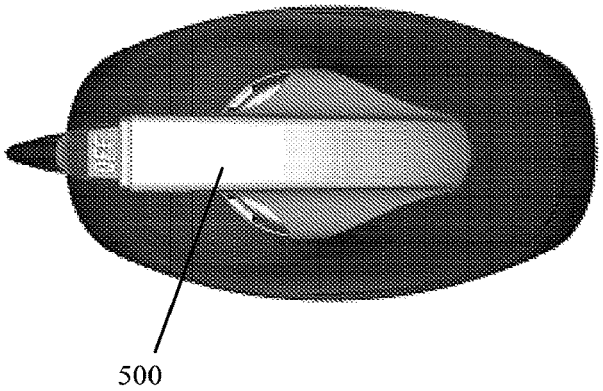
FIG. 39A illustrates a top-down view of a trigger sprayer pump system according to various embodiments of the invention.
Figure 39B:
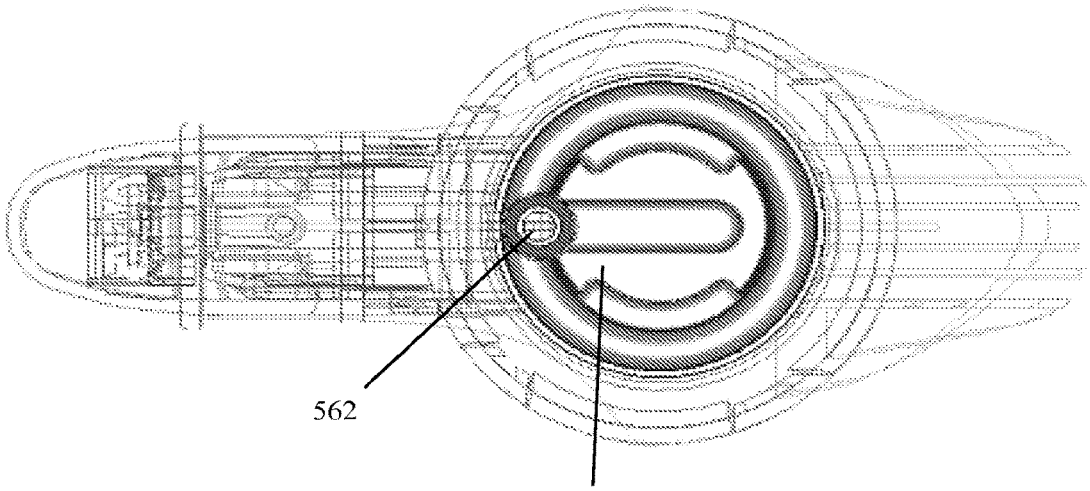
FIG. 39B illustrates a bottom-up view of a swivel adapter relative to a trigger sprayer in an engaged position according to various embodiments of the invention.

According to embodiments of the invention, a pump system 500 having a swivel adapter 560 may be assembled and disassembled with a bottle 900 having a blown-in dip tube 960. For example, a pump system 500 having a bayonet connection system may be assembled to a bottle 900 having a corresponding connection system as illustrated in FIG. 38. As illustrated, a pump system 500 may be aligned with an opening in the bottle 900 and forced downward onto the bottle 900 to connect thereto. During assembly and connection of the pump system 500, or trigger sprayer, with the bottle 900, the port 562 of the swivel adapter 560 may align with, mate, and seal with an opening in the blown-in dip tube 960. The pump system 500 may then be used. A top-down illustration of the pump system 500 attached to a bottle 900 is illustrated in FIG. 39A and a bottom-up view of the swivel adapter 560 relative to the pump system 500 in the attached position is illustrated in FIG. 39B.

Figure 40A:
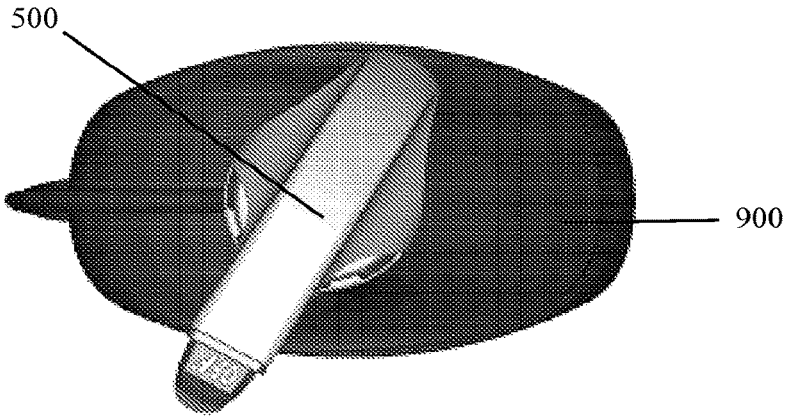
FIG. 40A illustrates a top-down view of a trigger sprayer pump system according to various embodiments of the invention.
Figure 40B:
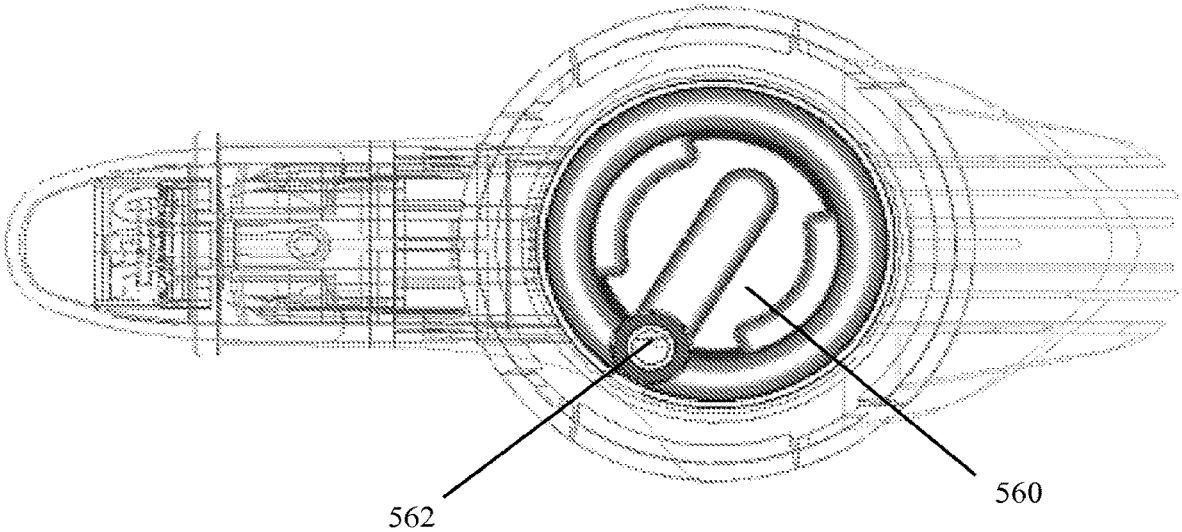
FIG. 40B illustrates a bottom-up view of a swivel adapter relative to a trigger sprayer in a disengaged position according to various embodiments of the invention.
Figure 41:
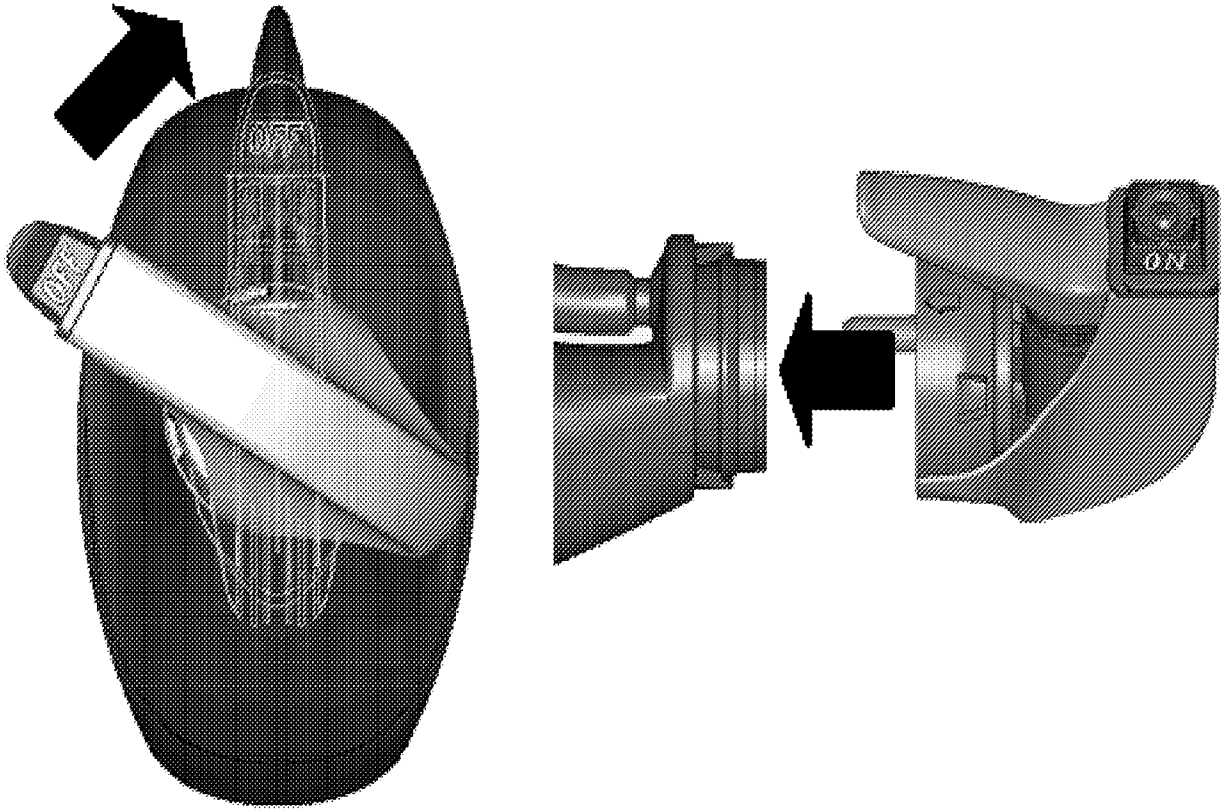
FIG. 41 illustrates a view of a trigger sprayer pump system having a swivel adapter being reattached to a bottle with a blown-in dip tube according to various embodiments of the invention.

To disengage the pump system 500 from the bottle 900 when a removable bayonet connection exists between the bottle 900 and valve body 150, the trigger sprayer portion of the pump system 500 may be rotated from the position illustrated in 39A to the position illustrated in FIG. 40A. The pump system 500 may then be removed from the bottle 900 and disengaged from the blown-in dip tube 960. A bottom-up view of the swivel adapter 560 relative to the pump system 500 in the disengaged position is illustrated in FIG. 40B. As illustrated, the swivel adapter 560 is able to rotate, allowing the swivel adapter 560 to stay engaged with the blown-in dip tube 960 until the pump system 500 is disengaged from the bayonet connection system and removed from the bottle 900.

To reattach a disengaged pump system 500 having a swivel adapter 560 according to various embodiments of the invention, the pump system 500 may be aligned with the bottle 900 such that the port 562 of the swivel adapter is aligned with an opening in the blown-in dip tube 960. The pump system 500 may then be lowered onto the bottle 900 as illustrated in 41 and twisted back into the attached position illustrated in FIG. 39A.

According to other embodiments of the invention, a swivel adapter 560 may also be used with a pump system 500 having a non-removable bayonet system for attaching a valve body 150 to a bottle 900. In such embodiments, the non-removable bayonet system may preclude or prevent disengagement of the trigger sprayer portion of the pump system 500 and bottle 900.

Figure 42:
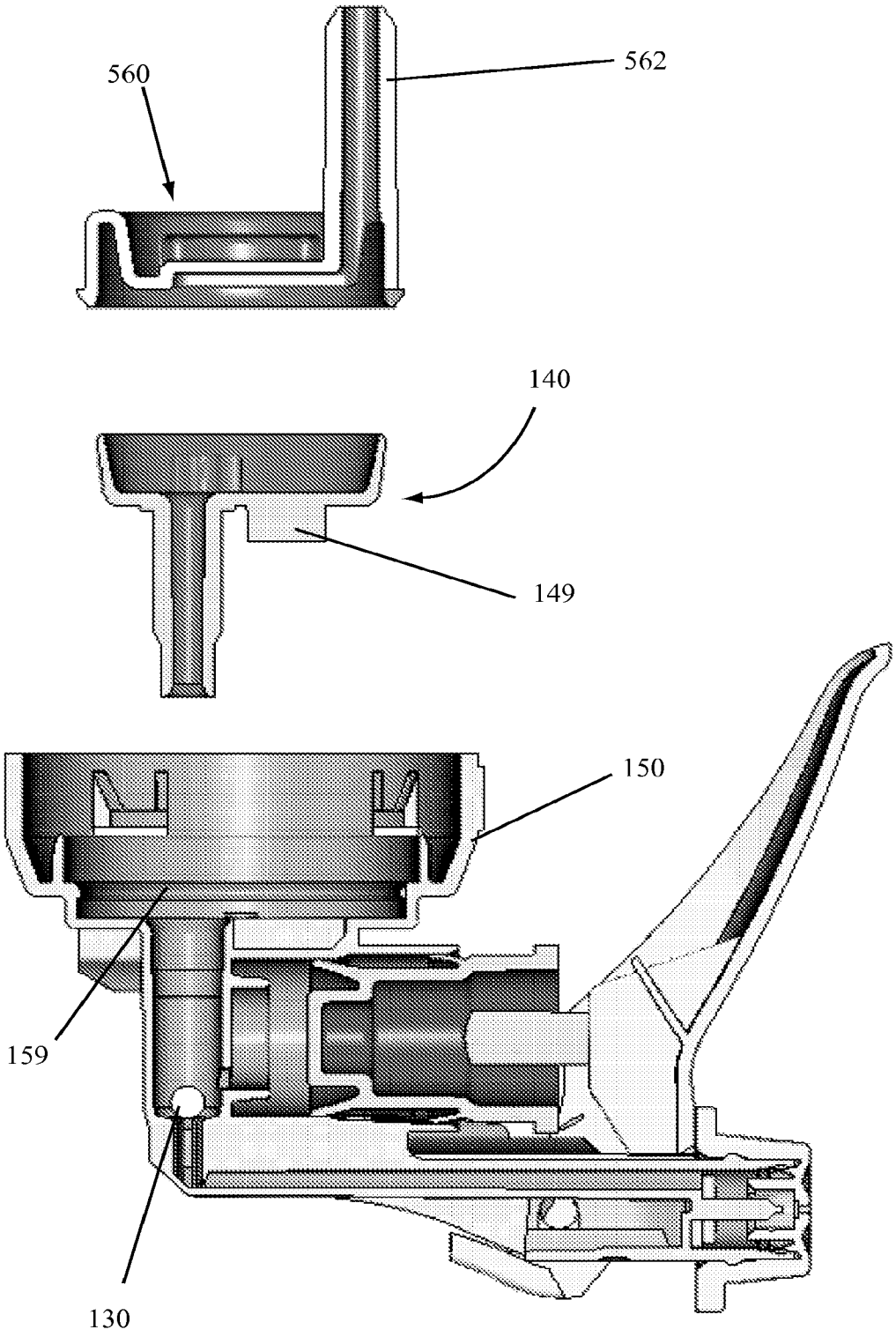
FIG. 42 illustrates a cross-sectional view of an assembly of a swivel adapter according to various embodiments of the invention with a trigger sprayer valve body and ball retainer.

According to various embodiments of the invention, a pump system 500 having a swivel adapter 560 may be assembled as illustrated in FIG. 42. A valve body 150 may be inverted and a ball or ball valve 130 inserted in a fluid path therein. A ball retainer 140 may be inserted in the fluid path to retain the ball valve 130. A swivel adapter 560 may be snap fit onto the valve body 150 and may form a fluid tight seal with the ball retainer 140. The resulting structure may be assembled to a bottle 900 having a blown-in dip tube 960 as described herein.

Figure 43B:
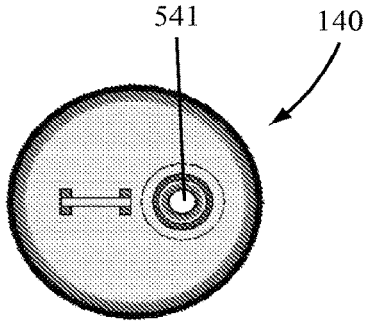
FIGS. 43A through 43E illustrate various views of a ball retainer according to certain embodiments of the invention.
Figure 43A:
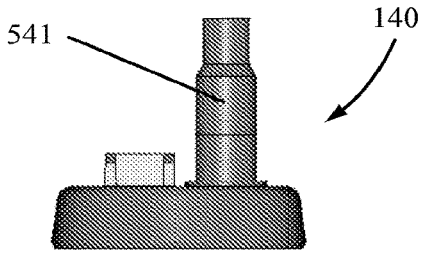
Figure 43C:
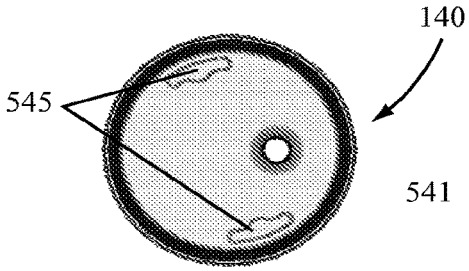
Figure 43D:
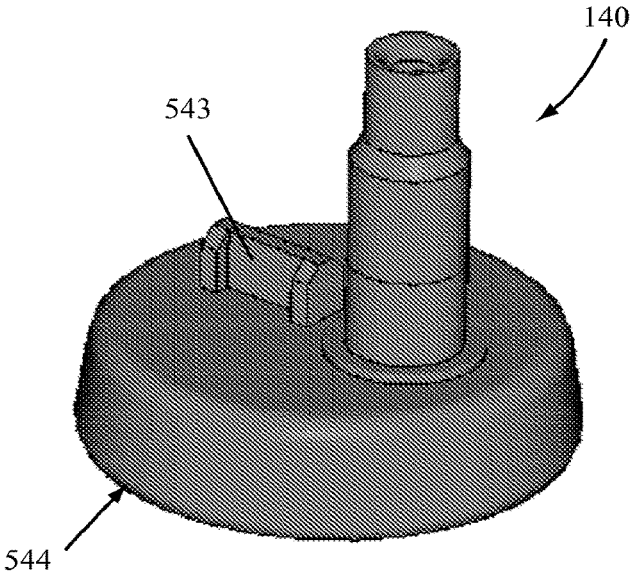
Figure 43E:
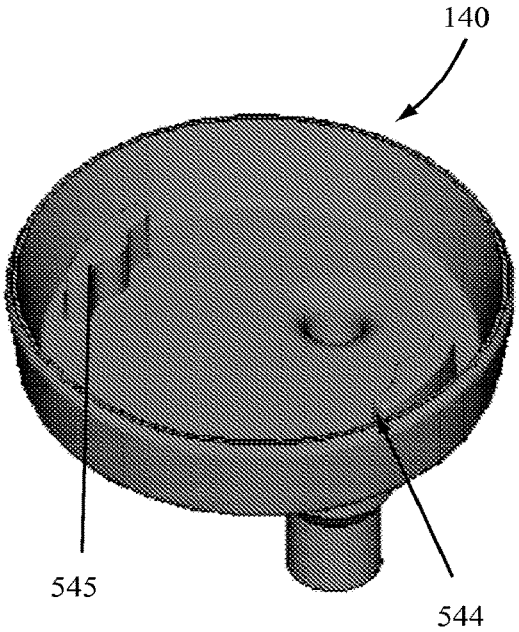

An example of a ball retainer 140 according to certain embodiments of the invention is illustrated in FIGS. 43A through 43E. FIG. 43A illustrates a side view, FIG. 43B illustrates a top-down view, FIG. 43C illustrates a bottom-up view, and FIGS. 43D and 43E illustrate perspective views of a ball retainer 140 according to certain embodiments of the invention. As illustrated, a ball retainer 140 may include a fluid path 541 or fluid supply line for transmitting fluid received from a blown-in dip tube 960 into the pump system as conventionally known. A ball retainer may also include one or more detents or stops 545 as desired. The one or more detents or stops 545 may work in conjunction with one or more detents or stops in a swivel adapter 560 to limit the range of rotation between the swivel adapter 560 and ball retainer 140. The one or more detents or stops 545 may also work with one or more detents or stops in a swivel adapter 560 to hold a swivel adapter 560 in a certain position following removal of a pump system 500 from a bottle 900 or during assembly of a pump system 500 to a bottle 900. One or more anti-torque features 543 may also be included as part of a ball retainer 140. The one or more anti-torque features 543 may limit movement of the ball retainer 140 during removal or assembly of a pump system 500 with a bottle 900. The one or more anti-torque features 543 may also mate with a valve body 150 to align or position the ball retainer 140 with the valve body 150 and prevent movement of the ball retainer 140 relative to the valve body 150 as the swivel adapter 560 rotates. A ball retainer 140 may also include one or more seals 544. The one or more seals 544 may be configured to mate with or seal against an interior portion of a swivel adapter 560 such that an interior portion of the ball retainer 140 and an interior portion of a swivel adapter 560 form a fluid chamber.

Figure 44B:
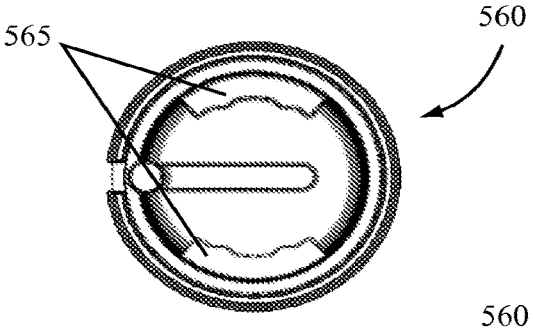
FIGS. 44A through 44E illustrate various views of a swivel adapter according to certain embodiments of the invention.
Figure 44A:
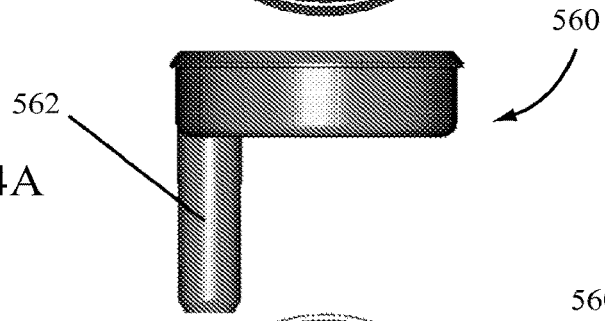
Figure 44C:
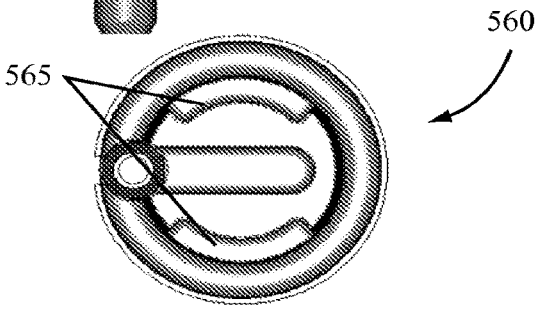
Figure 44D:
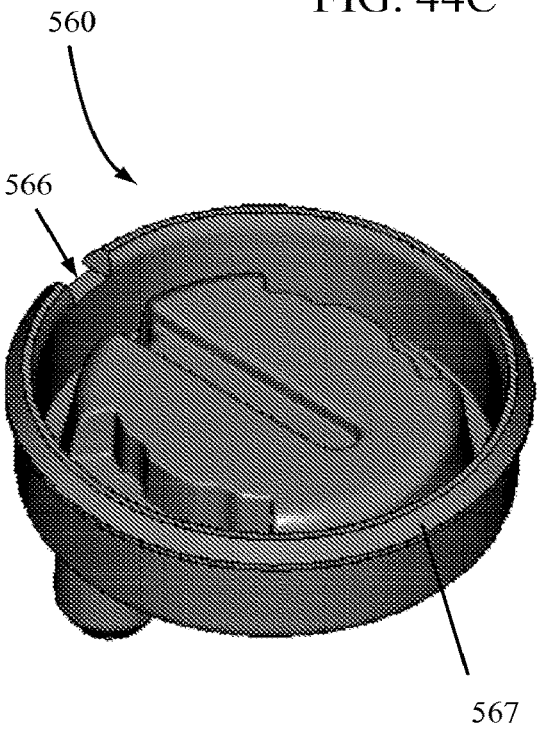
Figure 44E:
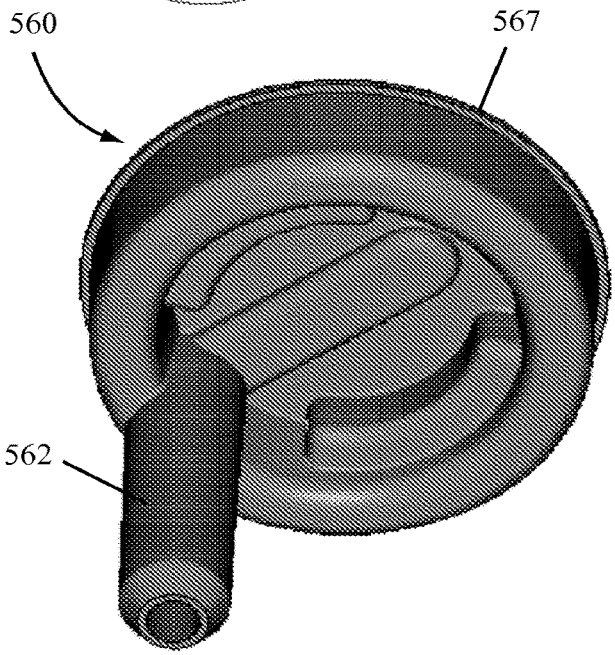

An example of a swivel adapter 560 according to certain embodiments of the invention is illustrated in FIGS. 44A through 44E. FIG. 44A illustrates a side view, FIG. 44B illustrates a top-down view, FIG. 44C illustrates a bottom-up view, and FIGS. 44D and 44E illustrate perspective views of a swivel adapter 560 according to certain embodiments of the invention. As illustrated, a swivel adapter 560 may include a port 562 having an entry or opening to a fluid path into an interior portion of the swivel adapter 560. One or more swivel detents or stops 565 may be formed on an interior of the swivel adapter 560 any may be configured to mate with or work with one or more detents or stops 545 of a ball retainer 140. A swivel adapter 560 may also include one or more vent ports 566 to allow venting of a bottle 900 when a pump system 500 is being operated.

According to certain embodiments, a swivel adapter 560 may also include one or more snap beads 567 or other attachment features to connect the swivel adapter 560 to a valve body 150. The one or more snap beads 567 may be configured to mate with or connect a swivel adapter 560 to a valve body 150. For example, one or more snap beads 567 of a swivel adapter 560 may snap into or about one or more connectors 159 on a valve body 150 to retain the swivel adapter 560 to the valve body 150. In various embodiments of the invention, the one or more snap beads 567 may allow the swivel adapter 560 to rotate relative to the valve body 150. In other embodiments, if the rotation or swivel of a swivel adapter 560 is not desired, the one or more snap beads 567 or other attachment features may create a fixed attachment between the swivel adapter 567 and the valve body 150.

According to various embodiments of the invention, the mating of a swivel adapter 560 with a ball retainer 140 may form a fluid chamber on an interior of the two components. When assembled with a valve body 150 and mated with a blown-in dip tube 960, fluid may pass from a blown-in dip tube 960 into the swivel adapter 560 and ball retainer 140 and into a piston chamber 151 of the valve body 150 to be sprayed as conventionally known. Thus, a swivel adapter 560 may provide a fluid connection between a blown-in dip tube 960 and a trigger sprayer.

A swivel adapter 560 according to embodiments of the invention may be made of a plastic or resin material. For example, a swivel adapter 560 may be made of a polyethylene material, high-density polyethylene (HDPE), low-density polyethylene (LDPE), medium density polyethylene (MIDPE), other such material.

Having thus described certain particular embodiments of the invention, it is understood that the invention defined by the appended claims is not to be limited by particular details set forth in the above description, as many apparent variations thereof are contemplated. Rather, the invention is limited only by the appended claims, which include within their scope all equivalent devices or methods which operate according to the principles of the invention as described.

What is claimed is:

1. A pump system, comprising:

a sprayer configured to be connected to a container, wherein the sprayer comprises a trigger and a valve body; and a flexible member configured to fluidly interconnect a blown-in dip tube in the container and the sprayer;

wherein the blown-in dip tube is formed with the container;

wherein the flexible member is configured to be directed to a connection end of the blown-in dip tube;

wherein the trigger is configured to be operated to pump a fluid through the blown-in dip tube and through the flexible member;

wherein the flexible member further comprises a sealing device configured to be inserted into the connection end of blown-in dip tube.

2. The pump system of claim 1, further comprising:

the container having the blown-in dip tube, wherein the blown-in dip tube extends from an enclosed end of the container to a sprayer connection end of the container;

wherein the connection end of the blown-in dip tube is nearer the sprayer connection end of the container than the enclosed end of the container.

3. The pump system of claim 2, wherein the flexible member includes a flexible tube;

wherein the flexible tube is fluidly connected with a fluid path in the valve body of the sprayer.

4. The pump system of claim 2, wherein the connection end of blown-in dip tube further comprises a funnel shaped wall configured to guide an end of the flexible tube into a sealing engagement with the blown-in dip tube.

5. The pump system of claim 1, wherein the flexible member is configured to create an indirect flow path from the connection end of blown-in dip tube to the sprayer.

6. The pump system of claim 1, further comprising:

a flexible member guide configured to guide the flexible member into engagement with the connection end of the blown-in dip tube.

7. A pump system, comprising:

a sprayer configured to be connected to a container, wherein the sprayer comprises a trigger and a valve body; and a flexible member configured to fluidly interconnect a blown-in dip tube in the container and the sprayer;

wherein the blown-in dip tube is formed with the container;

wherein the flexible member is configured to be directed to a connection end of the blown-in dip tube;

wherein the trigger is configured to be operated to pump a fluid through the blown-in dip tube and through the flexible member, further comprising:

a flexible member guide configured to guide the flexible member into engagement with the connection end of the blown-in dip tube;

wherein the flexible member guide includes at least one through hole to allow filling of the container through the flexible member guide into the container.

8. The pump system of claim 1, wherein the flexible member is connected to the sprayer at a fixed portion of the sprayer.

9. The pump system of claim 1, wherein the flexible member is configured to extend from the sprayer into the container to connect to the connection end of the blown-in dip tube formed in the container.

10. A pump system, comprising:

a sprayer comprising:

a trigger, a piston chamber, and a valve body;

a rotation connector configured to interconnect a container and the sprayer, wherein the rotation connector comprises:

a body configured to mate with the sprayer, and a port configured to mate with a connection end of a blown-in dip tube formed with a container, and wherein the rotation connector is configured to remain in one location with the port mated to the blown-in dip tube while the sprayer moves, thus allowing the port to maintain a fixed position relative to the blown-in dip tube as the sprayer moves relative to the container;

wherein the trigger is configured to be operated to pump a fluid through the blown-in dip tube and through the port.

11. The pump system of claim 10, wherein the rotation connector is configured to allow the port to remain fixed relative to the blown-in dip tube when the sprayer is removed from the container.

12. The pump system of claim 10, wherein the rotation connector further comprises a snap fit connection to connect to the sprayer.

13. The pump system of claim 12, wherein the valve body seals to the rotation connector.

14. The pump system of claim 10, further comprising:

a bayonet connection mechanism configured to connect the sprayer and the rotation connector.

15. The pump system of claim 10, further comprising:

the container having the blown-in dip tube, wherein the blown-in dip tube extends from an enclosed end of the container to a rotation connector end of the container;

wherein the connection end of the blown-in dip tip is nearer the sprayer connection end of the container than the enclosed end of the container.

16. The pump system of claim 15, wherein the connection end of the blown-in dip tip comprises a funnel.

17. The pump system of claim 15, wherein a fluid path is formed between the rotation connector and the valve body.

18. The pump system of claim 10, wherein the rotation connector further comprises swivel stops to limit a rotation of the sprayer relative to the rotation connector.

19. The pup system of claim 10, further comprising:

a flexible member configured to be fluidly interconnect the blown-in dip tube in the container and the sprayer.

* * * * *